US008264417B2

(12) United States Patent
Snow et al.

(10) Patent No.: US 8,264,417 B2
(45) Date of Patent: Sep. 11, 2012

(54) APERTURE ANTENNA WITH SHAPED DIELECTRIC LOADING

(75) Inventors: Jeffrey M. Snow, Bloomington, IN (US); Thomas Ball, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 478 days.

(21) Appl. No.: 12/540,114

(22) Filed: Aug. 12, 2009

(65) Prior Publication Data

US 2010/0220024 A1 Sep. 2, 2010

Related U.S. Application Data

(63) Continuation-in-part of application No. 11/821,475, filed on Jun. 19, 2007, now Pat. No. 7,940,225.

(51) Int. Cl.
*H01Q 13/02* (2006.01)

(52) U.S. Cl. ..... 343/786; 343/773; 343/785

(58) Field of Classification Search ..... 343/772, 343/773, 785, 786

See application file for complete search history.

(56) References Cited

U.S. PATENT DOCUMENTS

| | | | | |
|---|---|---|---|---|
| 2,845,622 | A * | 7/1958 | Gamble | 342/153 |
| 3,750,182 | A | 7/1973 | Kernweis | |
| 3,935,577 | A | 1/1976 | Hansen | |
| 4,255,753 | A * | 3/1981 | Lovick, Jr. | 343/786 |
| 4,318,103 | A * | 3/1982 | Roettele et al. | 342/20 |
| 4,878,061 | A * | 10/1989 | Nusair et al. | 343/786 |
| 5,883,604 | A | 3/1999 | Nicely | |
| 6,278,411 | B1 | 8/2001 | Ohlsson et al. | |
| 6,469,676 | B1 | 10/2002 | Fehrenbach et al. | |
| 6,593,893 | B2 | 7/2003 | Hou et al. | |
| 6,717,553 | B2 | 4/2004 | Sasaki et al. | |
| 6,750,827 | B2 | 6/2004 | Manasson et al. | |
| 6,879,297 | B2 | 4/2005 | Brown et al. | |
| 6,972,726 | B2 | 12/2005 | Sato et al. | |
| 6,972,728 | B2 | 12/2005 | Brown et al. | |
| 6,992,639 | B1 | 1/2006 | Lier | |
| 7,286,095 | B2 | 10/2007 | Parsche et al. | |
| 7,379,030 | B1 | 5/2008 | Lier | |
| 2004/0201534 | A1 | 10/2004 | Hagiwara | |
| 2006/0092087 | A1 | 5/2006 | Lange | |
| 2006/0125706 | A1 | 6/2006 | Amyotte et al. | |
| 2008/0129595 | A1 | 6/2008 | Choi et al. | |

FOREIGN PATENT DOCUMENTS

DE 3804118 9/1988

(Continued)

OTHER PUBLICATIONS

Philips, B.; Olver, A.D.; "Design and performance of profiled dielectric loaded horns"; *Microwaves, Antennas and Propagation, IEEE Proceedings*; Oct. 1994; vol. 141; Issue 5; p. 337-341; Electronics Laboratory, University of Kent; Department of Electronic Engineering, Queen Mary and Westfield College.

(Continued)

*Primary Examiner* — Tho G Phan
(74) *Attorney, Agent, or Firm* — Christopher A. Monsey

(57) ABSTRACT

An antenna structure and a method of propagating an electromagnetic (EM) wave with the antenna structure. The antenna structure comprises a first aperture antenna element and a second element inside the first element adapted to strengthen the directivity of the wave.

30 Claims, 18 Drawing Sheets

FOREIGN PATENT DOCUMENTS

| | | |
|---|---|---|
| GB | 2223360 | 4/1990 |
| WO | WO87/06066 | 10/1987 |

OTHER PUBLICATIONS

Institute of Electrical and Electronics Engineers (IEEE); IEEE Std 145-1993 (R2004); "Standard Definitions of Terms for Antennas"; p. 11; Sep. 23, 2004.

Coleman, Christopher; *Basic Concepts: An Introduction to Radio Frequency Engineering*; Cambridge University Press; 2004.

Orfanidis, Sophocles J.; *Electromagnetic Waves and Antennas* (e-book); Chapter 5, "Reflection and Transmission"; pp. 150-182; www.ece.rutgers.edu/~orfanidi/ewa; revised Feb. 14, 2008.

* cited by examiner

PRIOR ART

APERTURE ANTENNA WITH SHAPED DIELECTRIC LOADING

CROSS-REFERENCE TO RELATED APPLICATIONS

The present application claims priority to and is a continuation-in-part of U.S. patent application Ser. No. 11/821,475 titled "ANTENNA WITH SHAPED DIELECTRIC LOADING" filed Jun. 19, 2007 now U.S. Pat. No. 7,940,225, the entire disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used, licensed by or for the United States Government for any governmental purpose without payment of any royalties thereon.

FIELD OF THE DISCLOSURE

The invention relates generally to the fabrication and use of antenna systems used in transmitters and receiver systems. In particular, the invention concerns structures or portions of antenna structures used to shape emitted electromagnetic (EM) wave patterns as well as methods of manufacturing and use of the same.

BACKGROUND

Increasing use of high frequencies in radio frequency systems has led to a need to modify and adapt existing antenna structures. Driving antennas at a higher frequency tends to affect directivity and thus affecting the effective range of antennas. As discussed in Christopher Coleman's Basic Concepts, An Introduction to Radio Frequency Engineering, Cambridge University Press (2004), in EM, directivity is a property of the radiation pattern produced by an antenna. Directivity is defined as the ratio of the power radiated in a given direction to the average of the power radiated in all directions; the gain pattern is the product of the efficiency of the antenna and the directivity.

For example, FIG. 1 shows an antenna, frequently called a discone antenna, composed of a disc 1, a frustum circular conic section structure 3, conductors 7 and a voltage source 9 with a throat or feed gap 5, typically connected in such a manner as to have an axis of rotational symmetry 15. FIG. 2A shows the FIG. 1 antenna with an axis of rotational symmetry 15 that is perpendicular to the disc 1 and runs through the center of the cone structure 3. Discone antennas provide azimuthally (defined as the plane orthogonal to the axis of symmetry of the antenna and parallel to the disc component of the antenna) omni-directional field (radiation intensity) patterns over broad frequency ranges.

FIG. 2B shows an exemplary omni-directional radiation pattern. In particular, FIG. 2B shows an antenna with an elevation pattern 13A that is substantially directed perpendicular to the axis of symmetry 15, having a direction of the peak magnitude 11 of the elevation pattern.

FIG. 2C shows an exemplary radiation pattern at a higher frequency where the resulting elevation pattern 13B is oriented away from the axis perpendicular to the axis of symmetry by an angle 17 greater than 90 degrees. The FIG. 2C radiation pattern shows a maximum radiation intensity oriented toward the cone portion of the antenna. The direction from the origin of the spherical frame of reference for the antenna through the peak of the intensity pattern is defined by a function here represented by the direction of the pattern peak vector 11 when the elevation pattern is not parallel with the plane of the disc component of the antenna. The included angle 19 defines the degree of flair for the cone from the lower portion of the axis of symmetry 15. If a discone antenna with the radiation pattern as represented in FIG. 2C were mounted on a vehicle, for example, the direction of pattern peak would increasingly be below the horizon as frequency was increased, thus reducing the range and effectiveness of such a discone antenna.

Accordingly, there is a need for an improved antenna design which provides improved directional gain that also has a simple and highly durable design.

SUMMARY

An apparatus and method of manufacture for an antenna structure are described herein. The antenna structure comprises a first and a second antenna elements. The first antenna element comprises an elongate channel having an internal conductive surface and an apertured proximal end spaced apart from, and flaring out to, an apertured distal end. The conductive surface provides a propagation path and the proximal end receives EM waves in a first EM radiation pattern. The second antenna element is positioned at least partially within the first antenna element and has a proximal portion coupled to a distal portion. The proximal portion flares out from a proximal portion proximal end having a first cross-sectional area to a proximal portion distal end having a second cross-sectional area larger than the first cross-sectional area. The distal portion has a distal portion proximal end coupled to the proximal portion distal end and flaring in towards the apertured distal end. The second antenna element introduces a phase delay along the propagation path adapted to at least partially flatten a phase front of the first EM radiation pattern to produce a second EM radiation pattern.

BRIEF DESCRIPTION OF THE DRAWINGS

The above-mentioned and other disclosed features, and the manner of attaining them, will become more apparent and will be better understood by reference to the following description of disclosed embodiments taken in conjunction with the accompanying drawings, wherein.

DETAILED DESCRIPTION

Figure 1:
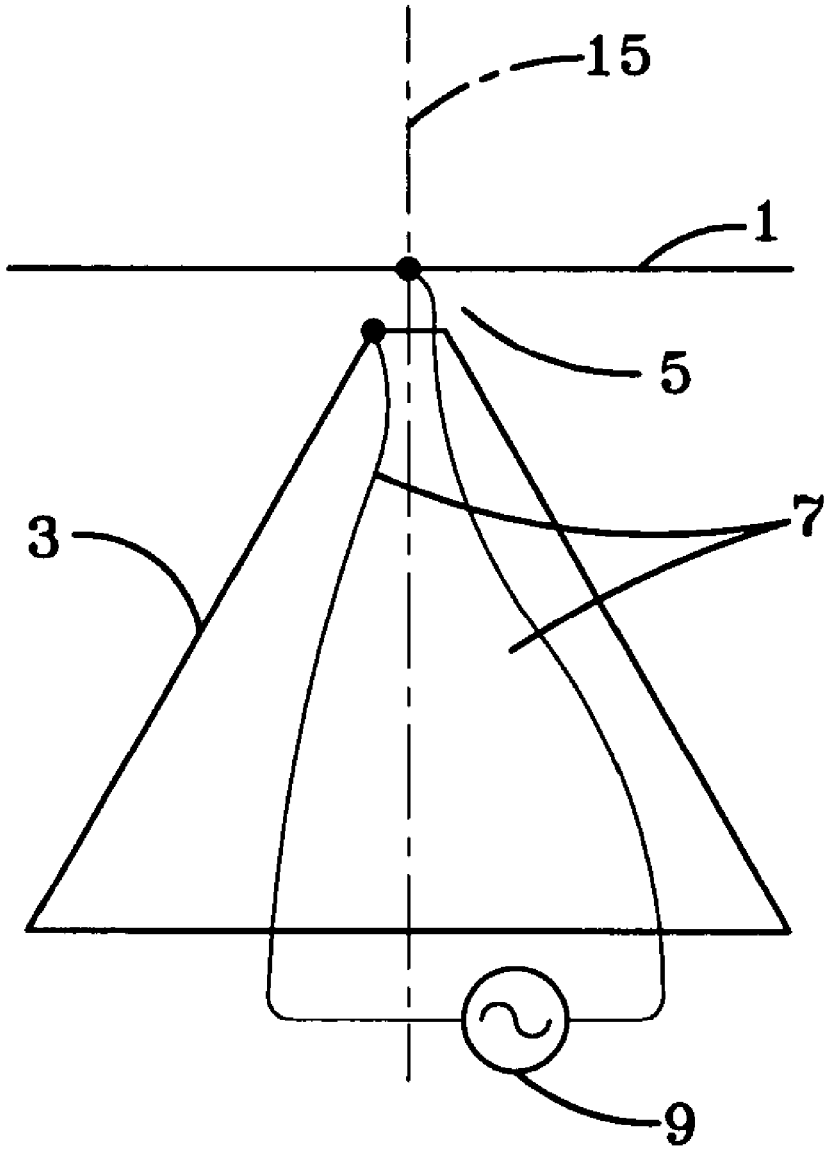
FIG. 1 shows an isometric view of a discone antenna.
Figure 2B:
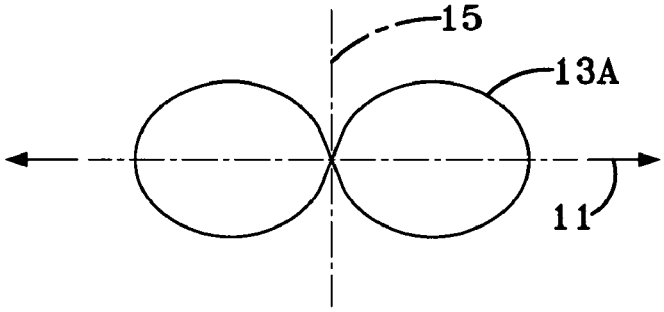
FIG. 2B shows an EM radiation pattern of the antenna shown in FIG. 2A at a first frequency.
Figure 2A:
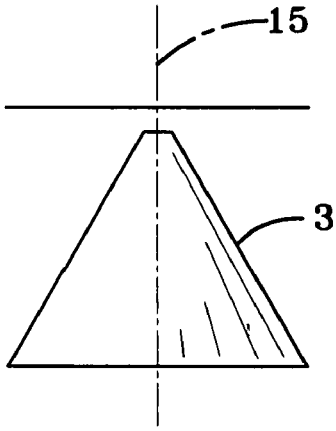
FIG. 2A shows a cross section of a discone antenna with a reference axis.
Figure 2C:
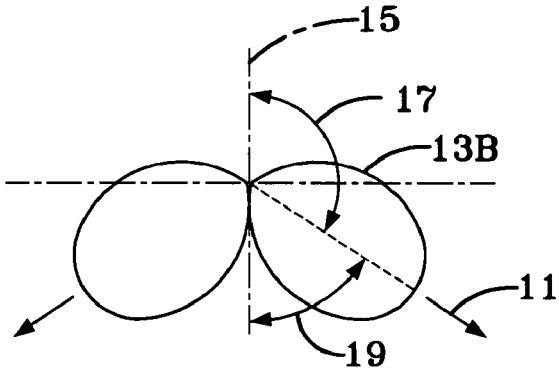
FIG. 2C shows an EM radiation pattern of an antenna shown in FIG. 2A at a second frequency.

An antenna or aerial is an arrangement of aerial electrical conductors designed to transmit or receive radio waves which is a class of EM waves. Physically, an antenna is an arrangement of conductors that generate a radiating EM field in response to an applied alternating voltage and the associated alternating electric current, or can be placed in an EM field so that the field will induce an alternating current in the antenna and a voltage between its terminals.

A radiation pattern is a graphical depiction of the relative field strength transmitted from or received by the antenna. Several curves or graphs are necessary to describe radiation patterns associated with an antenna. If the radiation of the antenna is symmetrical about an axis (as is the case in dipole, helical and some parabolic antennas) a unique graph is sufficient.

One definition of the term radiation pattern of an antenna is the locus of all points where the emitted power per unit surface is the same. As the radiated power per unit surface is proportional to the squared electrical field of the EM wave, the radiation pattern is the locus of points with the same electrical field. In this representation, the reference is the best angle of emission. It is also possible to depict the directivity of the antenna as a function of direction.

The "polarization" of an antenna can be defined as the orientation of the electric field (E-plane) of the radio wave with respect to the Earth's surface and can be determined by the physical structure of the antenna and by its orientation. EM waves traveling in free space have an electric field component, E, and a magnetic field component, H, which are usually perpendicular to each other and both components are perpendicular to the direction of propagation. The orientation of the E vector is used to define the polarization of the wave; if the E field is orientated vertically the wave is said to be vertically polarized. Sometimes the E field rotates with time and it is said to be circularly polarized. Thus, a simple straight wire antenna will have one polarization when mounted vertically, and a different polarization when mounted horizontally. EM wave polarization filters are structures which can be employed to act directly on the EM wave to filter out wave energy of an undesired polarization and to pass wave energy of a desired polarization. Polarization is the sum of the E-plane orientations over time projected onto an imaginary plane perpendicular to the direction of motion of the radio wave. In the most general case, polarization is elliptical (the projection is oblong), meaning that the antenna varies over time in the polarization of the radio waves it is emitting.

There are two fundamental types of antennas which, with reference to a specific three dimensional (usually horizontal or vertical) plane, are either omni-directional (radiates equally in all directions) or directional (radiates more in one direction than in the other). All antennas radiate some energy in all directions in free space but careful construction results in substantial transmission of energy in certain directions and negligible energy radiated in other directions. By adding additional conducting rods or coils (called elements) and varying their length, spacing, and orientation (or changing the direction of the antenna beam), an antenna with specific desired properties can be created.

Figure 3A:
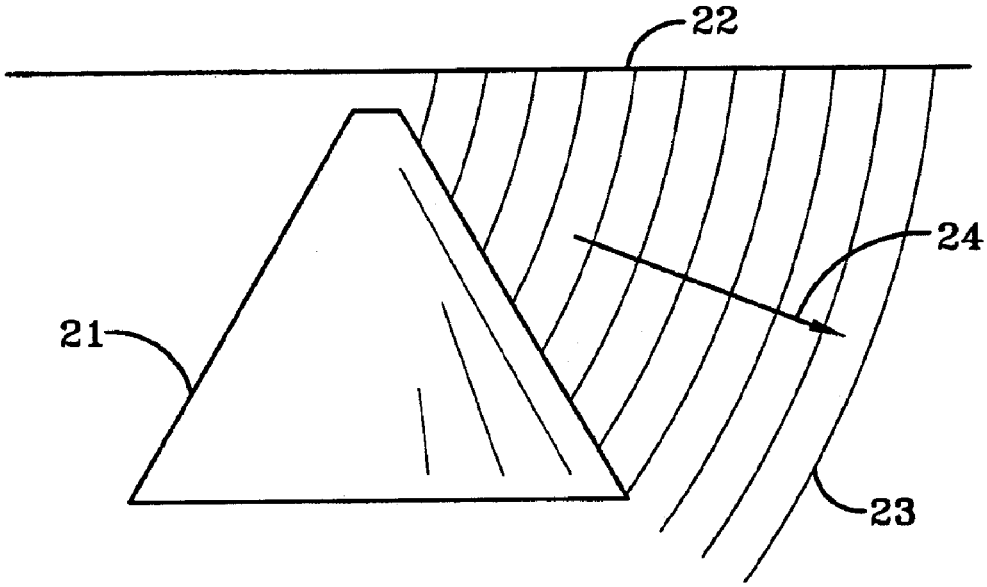
FIG. 3A shows a map of equal phase fronts and the associated poynting vector for an EM wave propagating through the structure of a discone antenna with the deflection associated with operation at higher frequencies.

Two or more antenna elements coupled to a common source or load produces a directional radiation pattern. The spatial relationship between individual antenna elements contributes to the directivity of the antenna as shown in FIG. 3A where the relationship of a disc 22 and a cone 21 influence the EM wave 23 propagation direction (poynting vector) 24. The term active element is intended to describe an element whose energy output is modified due to the presence of a source of energy in the element (other than the mere signal energy which passes through the circuit) or an element in which the energy output from a source of energy is controlled by the signal input.

EM waves can be shaped by causing them to undergo propagation delays relative to free space propagation. EM waves are slowed relative to waves traveling through media or regions with relatively lower dielectric constants when passing through media or regions of space with high dielectric constants.

An isotropic antenna is an ideal antenna that radiates power with unit gain uniformly in all directions and is often used as a reference for antenna gains in wireless systems. There is no actual physical isotropic antenna; a close approximation is a stack of two pairs of crossed dipole antennas driven in quadrature. The radiation pattern for the isotropic antenna is a sphere with the antenna at its center. Peak antenna gains are often specified in dBi, or decibels over isotropic. This is the power in the strongest direction relative to the power that would be transmitted by an isotropic antenna emitting the same total power.

From IEEE Standard 145-1993 (2004), "directivity (of an antenna in a given direction) is the ratio of the radiation intensity in a given direction from the antenna to the radiation intensity averaged over all directions." Equation 1 below provides the equation for directivity is as follows:

$$D(\phi, \theta) = \frac{4\pi\Phi(\phi, \theta)}{\Phi ave}$$

where $D(\phi, \theta)$ is the free-space directivity magnitude function of the antenna defined over the radial coordinate system where the angle $\theta$ is measured down from the axis of symmetry and the angle $\phi$ is measured from an arbitrary plane including the antenna axis of symmetry; $\Phi(\phi, \theta)$ the radiation intensity (power radiated per unit solid angle) of the antenna defined over the same coordinate system as $D(\phi, \theta)$ and wave is the global average of $\Phi(\phi, \theta)$ over all $\phi$ and $\theta$.

For passive antennas (those not including power amplifying components in their structure) directivity is a passive phenomenon—power is not added by the antenna, but simply redistributed to provide more radiated power in a certain direction than would be transmitted by an isotropic antenna. If an antenna has directivity greater than one in some directions, it must have less than one directivity in other directions since energy is conserved by the antenna. An antenna designer must take into account the application for the antenna when determining the directivity. High-directivity antennas have the advantage of longer effective range but must be aimed in a particular direction. Low-directivity antennas have shorter range but the orientation of the antenna is inconsequential.

A dielectric is a class of electrical insulator that is resistant to electric current and which is considered from the standpoint of its interaction with electric, magnetic or electromagnetic fields. Thus, dielectric materials are selected for specific applications based on their ability to store electric and magnetic energy as well as to dissipate such energy. When a dielectric medium interacts with an applied electric field, charges are redistributed within its atoms or molecules. This redistribution can alter the shape of an applied electrical field both inside the dielectric medium and in the region nearby. When two electric charges move through a dielectric medium, the interaction energies and forces between them are reduced. When an EM wave travels through a dielectric, its speed slows and its wavelength shortens. Dielectric materials are said to be non-conductive due to their resistance to electric current.

Dielectric materials include gases as well as liquids and solids. Some examples include porcelain, glass, and most plastics. Air, nitrogen and sulfur hexafluoride are commonly used gaseous dielectrics. Dielectric materials also include composite materials such as metal coated particles and materials comprising metal coated particles. By particles it is meant any non-conductive particles which are shaped in any of a plurality of shapes, e.g., spherical, cylindrical, rectangular, and also irregularly shaped. Particles also include granules and fibers. Composite materials such as polymers may be compounded, extruded and mixed to disperse the particles. Composite materials including particles which may be incorporated into pastes, reinforced polymers, spacers, adhesives and the like. Coating metals include Ni, Cu, Ag, and Au. Multilayer metal coatings consisting of the different metals/alloys may also be produced. Metal coated glass microspheres are available from Mo-Sci Corporation, 4040 HyPoint North Rolla, Mo. USA. Microspheres may comprise dense or porous glass, e.g., soda lime, silica, borosilicate, and aluminosilicate, and, given the current state of the coating technology, may comprise diameters as small as 1 μm. Particles may be extruded in polymers to form, for example, injection molded dielectric components wherein the microspheres, conductive nanoparticles and microparticles, and other particulate and non-particulate additives may be added in a controllable manner to produce dielectric components of desirable dielectric constants and electric loss properties. Advantageously, metal coated particles may provide a combination of low mass and low electric loss. Obviously electric loss is undesirable as it reduces gain. Thus, dielectric materials which do not absorb EM energy, e.g. have low loss tangent at a given transmission frequency, are desirable. Other dielectric materials in common use include, for example, silicon dioxide and silicon nitride.

Figure 3B:
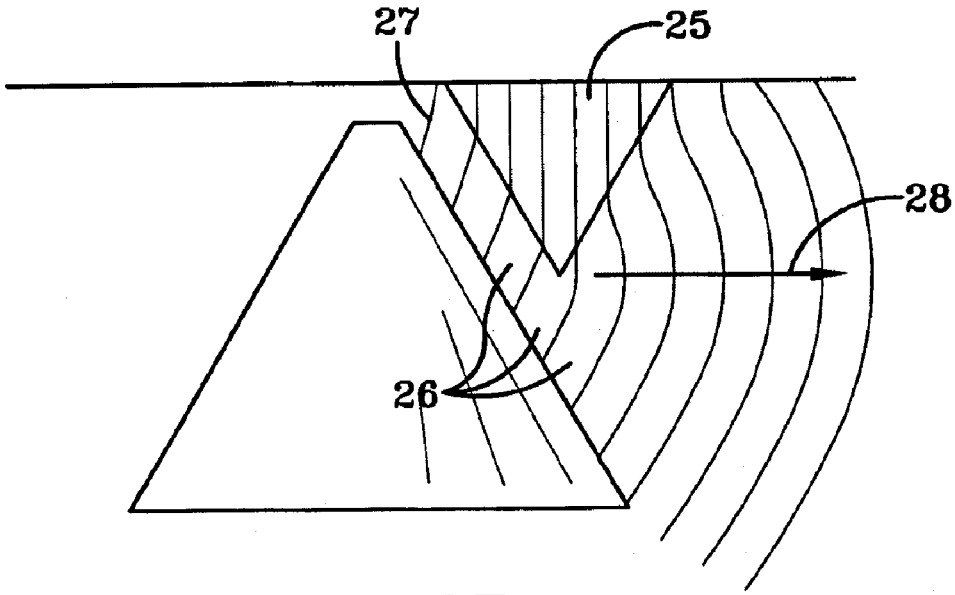
FIG. 3B shows a map of equal phase fronts and the associated poynting vector for an electro-magnetic wave propagating through the structure of a dielectrically loaded discone antenna with the attendant reduced deflection of the poynting vector associated with operation at higher frequencies.

Referring to FIG. 3B, the conjunction of regions, one with a relatively high dielectric constant, e.g., dielectric 25, and the other with a relatively lower dielectric constant, e.g., free space 26, can act as a refractor for an EM wave 27. The refractor, e.g., dielectric 25 and free space 26, alters the direction of propagation of the waves (poynting vector 28) emitted from the structure with respect to the waves impinging on the structure. It can alternatively bring the wave to a focus or alter the wave front in other ways, such as to convert a spherical wave front to a planar wave front. Thus a portion of a wave propagating through a region with a high dielectric constant could travel slower than another portion traveling through a region with a lower dielectric constant.

Figure 4:
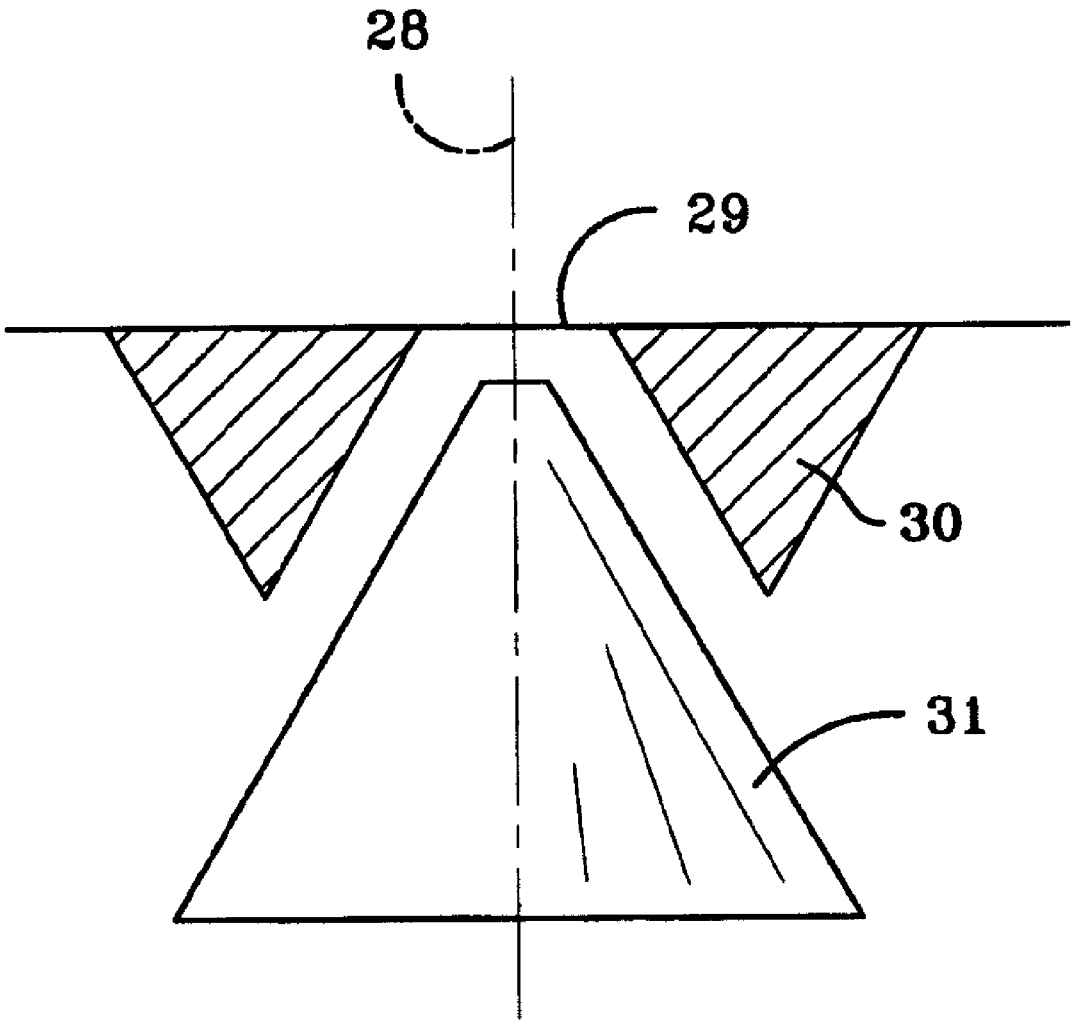
FIG. 4 shows an antenna with dielectric material for affecting wave propagation.

FIG. 4 shows one embodiment of the invention with a discone antenna comprising a disc 29 and a frustum circular conic structure 31 that are formed relative to an axis of symmetry 28 which is perpendicular to the planar surface of the disc 29. An annular structure of dielectric material 30 with a triangular cross section is formed onto the lower peripheral surface of the disc 29. The dielectric portion 30 design in this embodiment can be determined by varying its shape and dielectric composition so that, based on the desired frequency range, the overall EM field or radio frequency wave that is generated by the antenna in question is shifted towards the horizon. Effectiveness of the various shapes and compositions can be determined through modeling methods using modeling software that is commercially available or through empirical testing of the antenna designs using probe and test equipment. Having more dielectric material in the area of the disc 29 causes the EM wave to travel slower along the direct surface path along the disc 29 due to the relatively higher dielectric property of the dielectric (as compared to another medium, in this case free space) causing a phase delay that pulls the EM wave (and therefore the field pattern peak) towards the plane of the disc 29. This effect is more pronounced as frequency is increased. The advantage of this design is that the direction of the peak directivity of the antenna is closer to or on the horizon for all or most of its frequency band. Moreover, the dielectric material may be changed to modify the pattern of an existing antenna.

Figure 5:
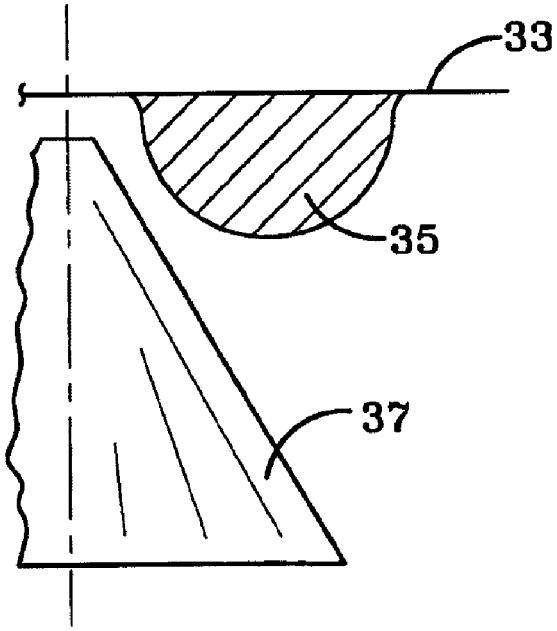
FIG. 5 shows another embodiment of the invention with a differently formed dielectric material.

Various solid shapes of dielectric can be utilized with a discone antenna design, either in contact or not in contact with the disc. Use of multiple layers or regions of dielectric material with differing dielectric constants can be used to reduce reflections at each dielectric interface and improve shaping of the elevation pattern. For example, FIG. 5 shows another embodiment of the invention where the dielectric material 35 has a smooth shaped surface with cross section in either the form of a circular segment or an elliptical segment formed on the periphery of the disc 33 but has a gap between the disc 33 and the frustum circular cone 37.

Figure 6:
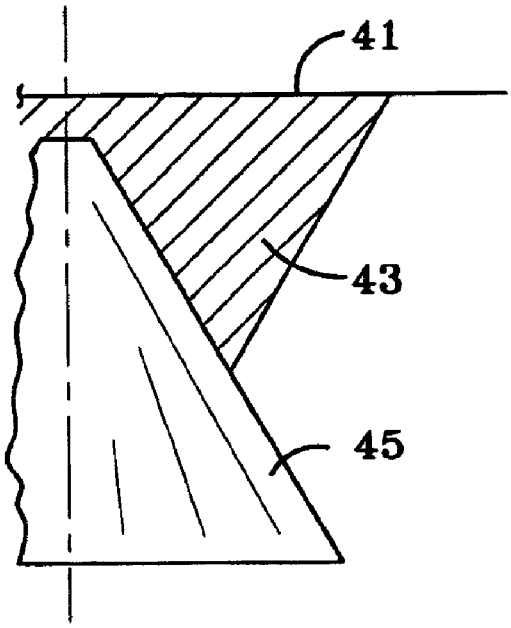
FIG. 6 shows another embodiment of the invention with another form for a dielectric material formed through the throat of a discone antenna.

FIG. 6 shows another embodiment where a dielectric 43 is formed in contact with disc 41 and a portion of the frustum circular cone 45.

Figure 7:
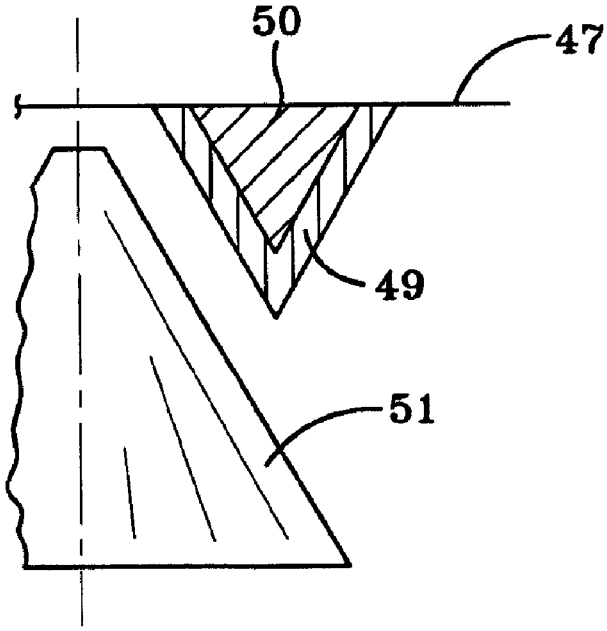
FIG. 7 shows another embodiment of the invention with a dielectric formed of a plurality of layers.

FIG. 7 shows another embodiment of the invention using a discone antenna structure comprising a disc 47 with layered dielectric materials 49, 50 formed on an annular structure with a triangular radial cross section onto an outer periphery of disc 47 but not in contact with the circular cone section 51. Dielectric material 50 is first formed on the lower portion of the planar surface of disc 47 in a triangular cross sectional form. Dielectric material 49 is formed into a triangular form on the lower portion of the planar surface of the disc 47 so as to encapsulate dielectric material 50 forming a combined structure composed of two different dielectric materials 49, 50. The dimensions of the two layers 49, 50 are determined based on the effect that refractive properties of the two layers have on a portion of the EM field generated from the disc 47 and circular cone 51 antenna combination.

Figure 8:
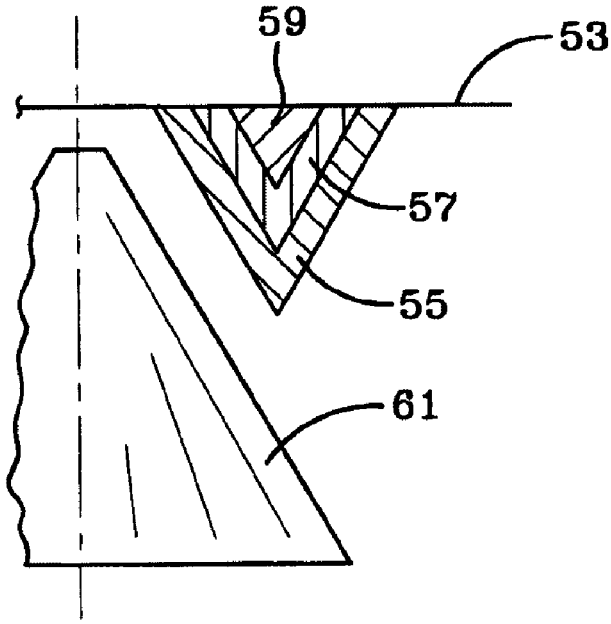
FIG. 8 shows another embodiment of the invention having a different plurality of layers.

FIG. 8 shows another embodiment of the invention where three dielectric layers 55, 57, 59 are formed as an annular structure with a triangular cross section onto the surface of the disc 53 facing the cone structure 61 of the discone antenna.

While a triangular shape is again used for the shape of the three dielectrics, one on top of the other, it should be noted that the invention in this case is not limited to this particular shape or placement on a disc of a discone antenna. Dielectric material can be placed in various portions of an antenna, such as a discone antenna. It is also possible to design an antenna using various shapes and dielectric materials as to achieve the desired effect on directional gain by placement of the phase shifting material on a portion of the antenna structure.

Figure 9:
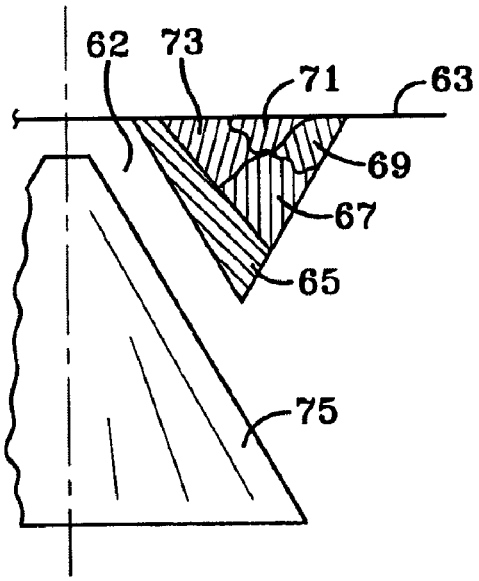
FIG. 9 shows another embodiment of the invention having a plurality of layers with different shapes.

FIG. 9 shows another embodiment of the invention where dissimilarly shaped dielectric layers 65, 67, 69, 71 and 73 form a composite structure having an outer shape of a triangular cross section which are used to adjust the refractive properties associated with phase shifting a portion of an EM wave to refract the EM wave in a predetermined direction. In this example, there is a gap 62 between the dielectric composite structure of dielectrics and the discone cone section 75. The composite structure of dielectrics can be formed in contact with a portion of the cone section 75. Multiple layers and irregularly shaped dielectrics permits reduction of reflections of the EM wave over an EM refractive boundary formed by two areas having a different dielectric constant. Accordingly, more than one layer is preferred if there is a need to increase EM energy in a preferred direction. Irregularly shaped layers are useful to further tune or mitigate reflections in a particular portion of the wave front.

Figure 10:
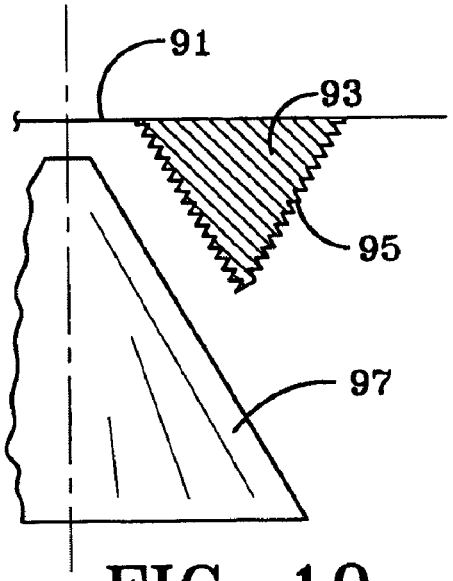
FIG. 10 shows another embodiment of the invention having at least one dielectric layer formed into a triangular cross section form with peripheral grooves.

FIG. 10 shows an embodiment where a dielectric material 93 is formed onto the disc 91 of the discone antenna structure with peripherally oriented grooves 95 cut into the outer surfaces of a dielectric material 93. The grooves and dielectric material is formed to affect the radiation pattern and propagation of the EM waves passing through the structure. Other variants of surface shaping can be used to alter wave forms and reduce reflections.

Figure 11:
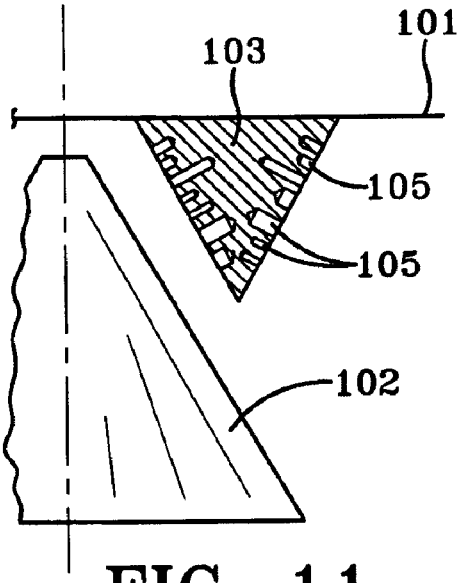
FIG. 11 shows another embodiment of the invention having surface features in a portion of an antenna including dielectric material formed with holes to further influence wave propagation through the dielectric material.

FIG. 11 shows another embodiment of the invention having dielectric material 103 formed on a surface of a disc 101 which is oriented towards a circular cone 102 of a discone antenna. In particular, the dielectric material 103 is formed with holes 105 which further influence wave propagation through the dielectric material 103. The holes 105 may be formed to varying depths and/or diameters in order to further tune wave propagation through the dielectric material 103. In this embodiment, the holes 105 are shown as being radially aligned, but need not be so aligned depending on the requirements of the implementation.

Figure 12:
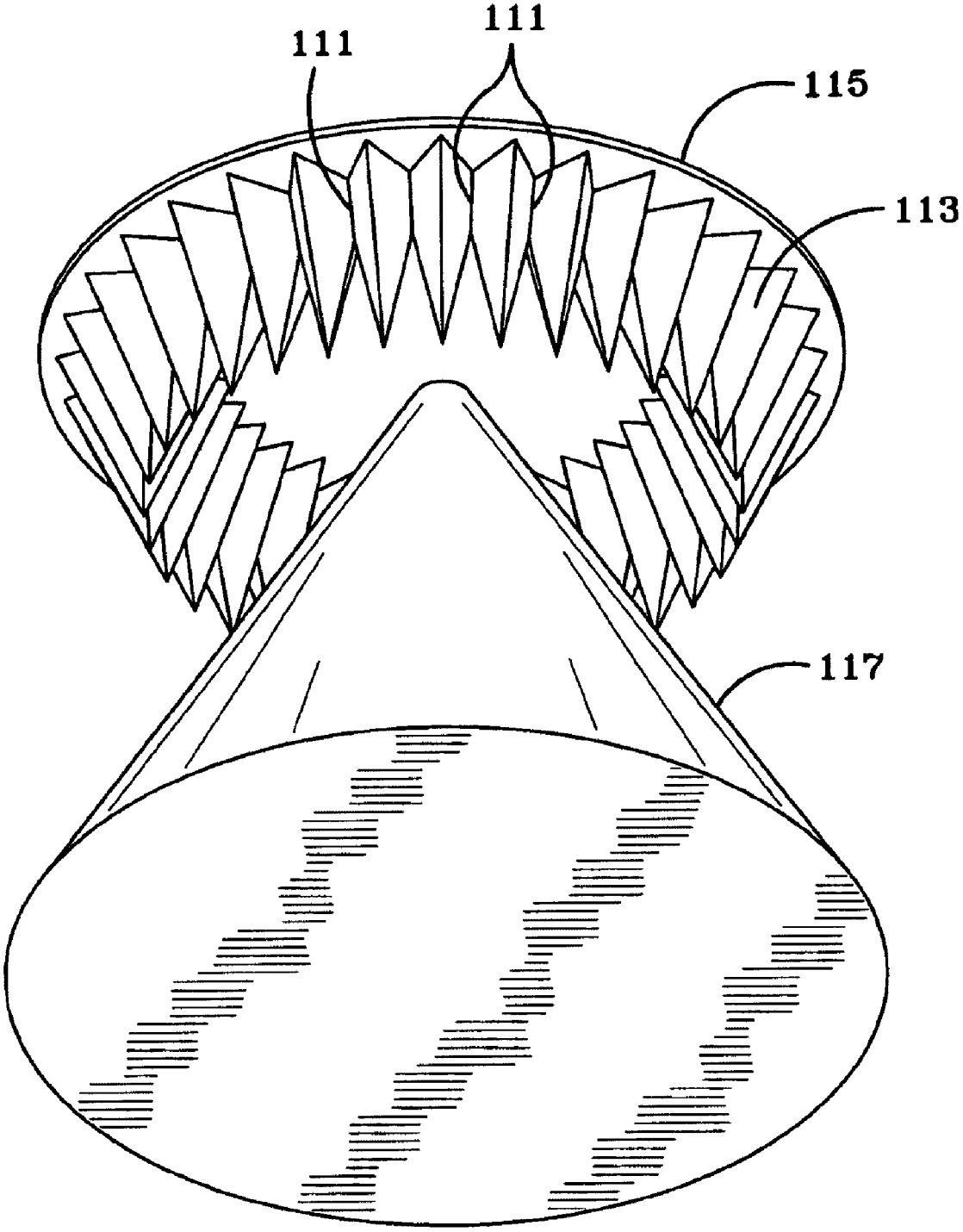
FIG. 12 shows an isometric view of another embodiment of the invention having a dielectric material formed into a triangular shape on a disc section of a discone antenna that is generally oriented towards a cone section of the discone antenna, where axial grooves are formed into two of the faces of the triangular shape.

FIG. 12 shows another embodiment of the invention where a dielectric material 113 is formed onto an outer disc 115 of a discone antenna on the side oriented towards a frustum circular cone 117. The dielectric material 113 is formed into a triangular annular form with radial/axial grooves 111 formed onto two outer surfaces of the dielectric material 113 not in contact with the disc 115 forming "teeth like" protrusions. Other variants of surface shaping can be used to alter wave forms in a preferential direction and reduce reflections.

Figure 13:
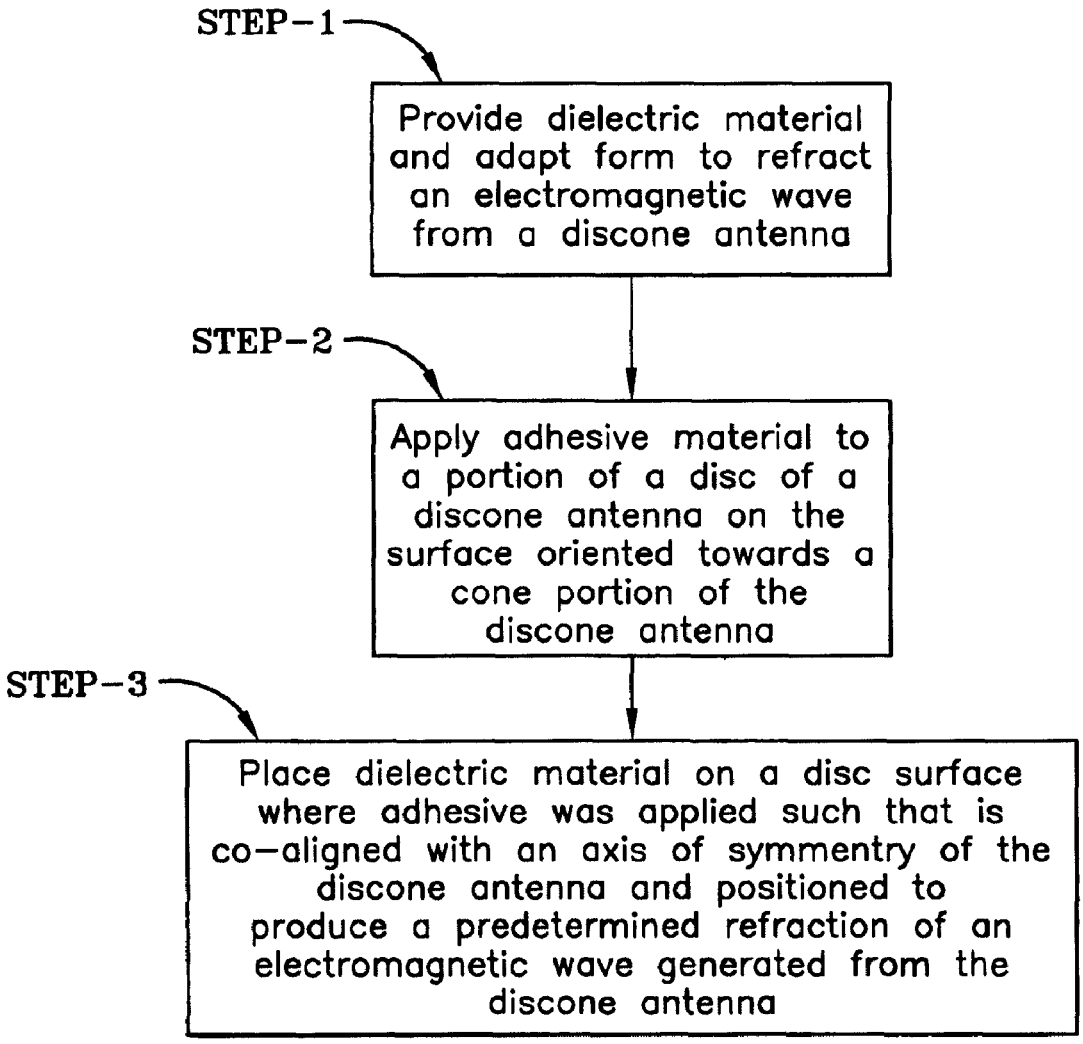
FIG. 13 shows an exemplary method of manufacture for one embodiment of the invention.
Figure 14:
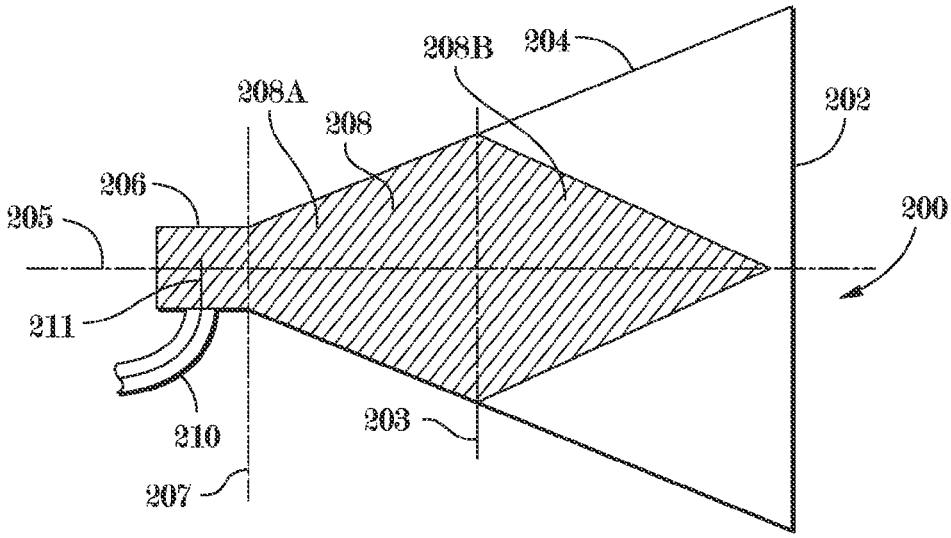
FIGS. 14 to 17B show lateral cross-sectional views and frontal plane views of embodiments of dielectric components inserted in an aperture antenna.

FIG. 13 shows one method of manufacture of an exemplary embodiment of the dielectric loaded discone antenna. At step 1, a dielectric material is provided and adapted to refract a portion of an EM wave generated from a discone antenna such that the wave front of the EM wave propagates in a predetermined direction upwards towards a plane that contains a disc portion of a discone antenna to produce an annular dielectric component. It should be noted that the dielectric material formed in this case will always refract an EM wave but more refraction will occur at higher frequencies. At step 2, an adhesive material is applied to a portion of the disc of the discone antenna oriented towards the frustum circular cone of the discone antenna. At step 3, the annular dielectric component is placed on the surface of the disc of the discone antenna oriented towards the frustum circular cone portion of the discone antenna and co-aligned along the axis of symmetry of the discone antenna and attached with the adhesive previously applied to the disc. Placement in this embodiment is accomplished to position the dielectric material to refract EM waves in a predetermined direction. It should be noted that any means can be used to couple the dielectric component to the discone antenna which will allow joining of the two components. Alternatively the dielectric material could be deposited upon the disc by a variety of deposition methods to achieve rough form and subsequently machined to its final shape. Added layers could subsequently be deposited upon or attached to disc and dielectric as required. The figure shows a triangular shape of the dielectric material however the actual surface shape of the dielectric material can be added to produce a desired change in directivity of an EM wave produced by passing an EM wave through a dielectric.

Various embodiments of the invention comprising aperture antennas with shaped dielectric loadings will now be described with reference to FIGS. 14 to 29. Aperture antennas include slots, open-ended waveguides, horns, reflector and lens antennas. Generally, an aperture antenna comprises a wave generator adapted to produce EM waves in a first EM radiation pattern and a first element, or horn. The horn comprises conductive surfaces which generate electromagnetic fields with low losses thereby producing a second EM radiation pattern as the EM waves having the first EM radiation pattern propagate through the horn. Thus, the horn produces a second EM radiation pattern based on a received first EM radiation pattern. In embodiments of the invention described below, a second element, or dielectric component, is provided which modifies the second EM radiation pattern as the waves reflected from the conductive surfaces transition into, and then out of, the dielectric component. Dielectric components having multiple layers and shapes comprise multiple transitions, or interfaces, and the dielectric component thus has an "effective" dielectric constant based on the dielectric constants, shapes and structures of the multiple layers.

An open ended waveguide represents the simplest form of an aperture antenna. The directivity of the open ended waveguide can be increased by flaring out the ends of the waveguide into a three-dimensional structure which is referred to as the horn. Flared waveguides may comprise a rectangular horn flared primarily in either of the E or H planes, conical horn for circular waves, and pyramidal shaped horn to increase directivity in two planes. Typically, the horn of an aperture antenna is fed or tapped to a transmission line or wave generator, usually a waveguide or coaxial cable and throat, leading to the flare. Rectangular flared horns have two axis of symmetry while conical horns are circularly symmetrical.

The shape of the flare affects the shape of the wave produced by it, e.g., the amount and type of modification on the first EM radiation pattern. The phase front is retarded from the center of the aperture to its edges and the phase differences increase proportionally with increases in the size of the horn. The phase differences limit gain and create undesirable lobes such as sidelobes and backlobes. Dielectric components can be added to compensate for the phase differences resulting from the flared antenna's shape to at least partially flatten the phase front across the face of the aperture. By "flatten" it is meant that the dimension of the EM radiation pattern along the direction of propagation is compressed or reduced, at least partially. Flattening produces advantageous improvements even if it does not equate to a flat pattern, e.g. A two-dimensional pattern resulting from complete reduction of the dimension of the pattern along the direction of propagation. As a result, the directivity and gain of the aperture antenna may be improved. Aperture antennas may be used to transmit and receive directly and also as feed horns for dishes and lenses. For feed horns, gain is not as important as beam angle and phase center which may also be impacted by the addition of dielectric components.

A plurality of dielectric components may be provided to aperture antennas to attenuate reflections caused by medium transitions. Dielectric components may be layered as shown in FIGS. 18 to 23 for example. Succeeding layers may have higher dielectric constants than layers preceding them which may be disposed, at least partially, between the throat and the succeeding layer. Because larger dielectric constant differences create larger transitions and corresponding reflections as waves travel through the transitions, layering mitigates the effect of larger transitions by providing a plurality of smaller transitions. In other words, layering can be used to "design" a pattern of transitions which, advantageously, improves the gain and directivity of the antenna as compared to the use of a similarly shaped but unlayered dielectric component. Layering thus increases gain by reducing reflections. Components with high dielectric constants may be provided in the throat space as well to suppress arcing which may occur when high power signals are provided to horns with relatively small cross-sectional throat areas. By high power it is meant a power level which would normally cause arcing if the high dielectric constant component were not applied. The reflection and transmission of waves in the horns and through the different materials may be modeled as a sequence of transitions, or interfaces, spaced apart by material slabs as explained by Sophocles J. Orfanidis in the e-book titled "Electromagnetic Waves and Antennas," Chapter 5 titled "Reflection and Transmission," pgs. 150-182, available from www.ece.rutgers.edu/-orfanidi/ewa, revised Feb. 14, 2008, the contents of which are incorporated herein in their entirety by reference. As described further below, the peripheral shape of the interfaces, the number of interfaces, and the dielectric constant of the materials may be changed to improve the directivity and gain of a horn without substantially altering its shape.

The dielectric components may be provided with uniquely shaped openings or cavities, as described below with reference to FIGS. 24 to 27, to further reduce reflection effects. Openings may have centerlines disposed parallel to external surfaces of the dielectric component, e.g., grooves and slots formed by elongate protrusions such as ridges, and also centerlines which are not parallel to external surfaces and which may be, for example, substantially perpendicular to the external surfaces and may comprise cylindrical shapes, for example. The unique shapes may be filled with dielectric material fillers having dielectric constants different from that of the dielectric component being filled. A person having skill in this art aided by the descriptions in the preceding paragraphs and the figures will understand that a multitude of uniquely shaped dielectric components may be constructed to satisfy as many performance requirements and that the invention herein described is not limited to the figures disclosed. The following descriptions of FIGS. 14 to 29 are provided to exemplify a number of design factors which may be manipulated to satisfy the multitude of potential performance requirements.

FIGS. 14 to 29 are plane views of aperture antennas comprising a horn 204, a throat 206 and an aperture 202 disposed at the distal end of the horn 204 relative to the throat 206. The aperture antennas comprise dielectric components having varying dielectric constants. In one embodiment depicted in FIG. 14, a dielectric component 208 is positioned into the throat 206 and a portion of the horn 204 of the horn antenna 200. A cross-section of the horn 204 is shown. The horn 204 provides a propagation path from a proximal aperture of the horn 204 in a plane perpendicular to a centerline 205 of the antenna denoted by line 207 to a distal aperture, e.g., aperture 202. A coaxial cable 210 having a wire 211 is shown in the throat 206 which produces EM waves in an EM radiation pattern, and the waves enter the horn 204 and are reflected therefrom as they propagate therethrough into transitions or interfaces created by the introduction of the dielectric component 208 before the waves are refracted as they enter and exit the dielectric component 208. The dielectric component 208 has a proximal portion 208A shaped similarly to the space into which it is inserted to conform thereto, and a distal portion 208B. The proximal portion 208A has a first cross-section in the plane of the proximal aperture and flares out to a plane denoted by line 203 at which it has a second cross-section. The distal portion 208B flares in from the plane denoted by line 203. The distal portion 208B of the dielectric component may be conical or frustroconical and may also comprise a plurality of flat or substantially flat surfaces. The dielectric component introduces a phase delay along the propagation path adapted to at least partially flatten a phase front of an EM radiation pattern reflected from the horn 204.

Figure 15:
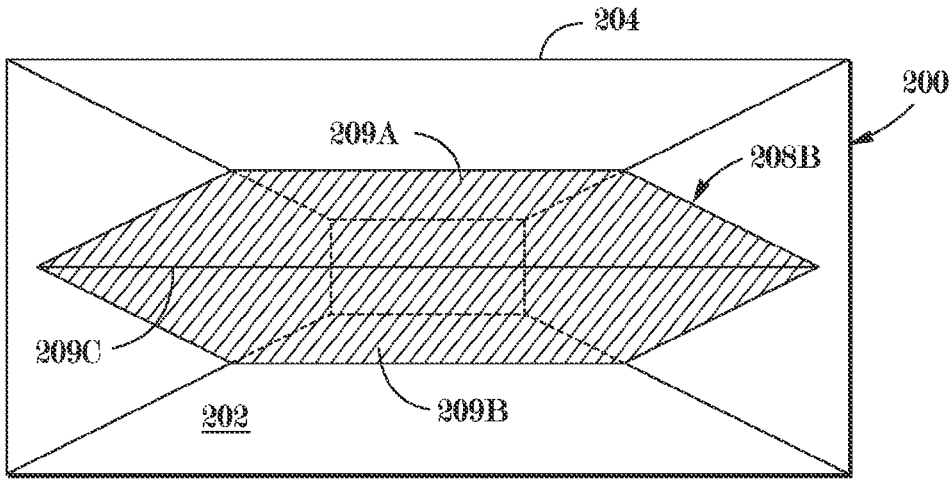

A plane frontal view of the distal portion 208B of the dielectric component 208 is shown in FIG. 15. The distal portion 208B comprises two converging surfaces 209A, 209B forming an edge 209C which may be rounded. The edge 209C may be aligned with a plane passing through aperture 202 which is perpendicular to it and equidistantly positioned relative to the upper and lower edges of aperture 202 oriented as shown in FIG. 15. Alternatively, the edge 209C may closer or further apart from one edge of the aperture 202 than the other edge. Also, the edge 209C may be obliquely aligned rather than being parallel to the upper and lower edges of aperture 202.

Figure 16:
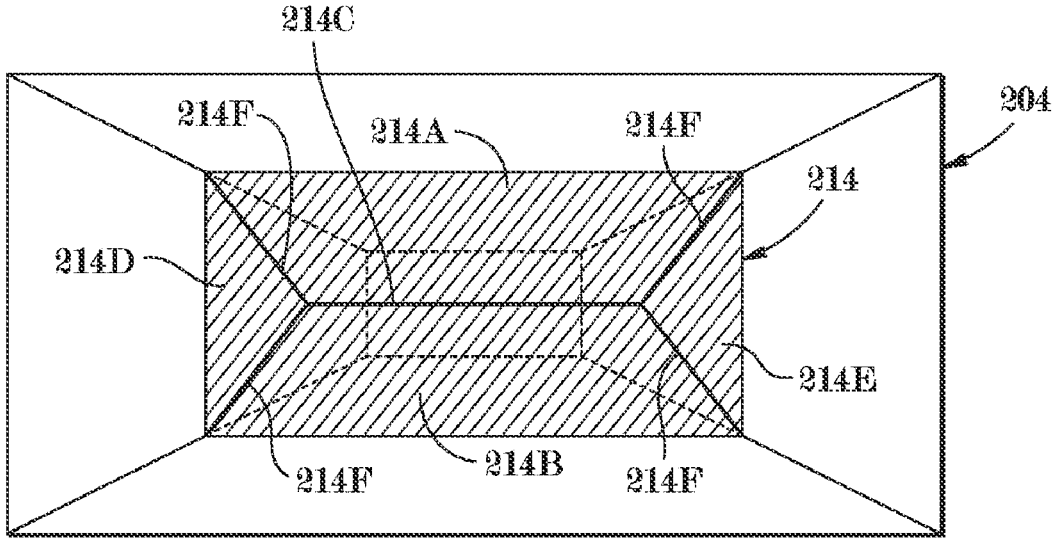

A plane view of a distal portion 214 of another embodiment of a dielectric component is shown in FIG. 16. The distal portion 214 comprises two surfaces 214A, 214B forming an edge 214C similar to edge 209C but of a smaller length, and surfaces 214D and 214E. The distal portion 214 provides a less significant bi-directional phase delay than that provided by the distal portion 208B due to the effect of surfaces 214D and 214E which reduce the dielectric volume of the distal portion 214 as compared to the distal portion 208B.

Figure 17:
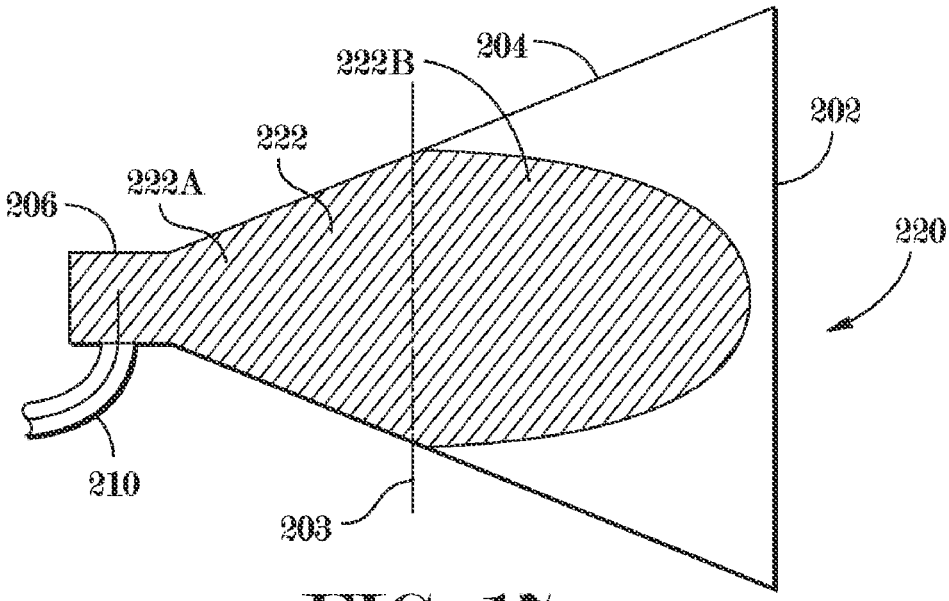

In another embodiment shown in FIG. 17, a dielectric component 222 is shown having a proximal portion 222A and a distal portion 222B. The distal portion 222B is similar to the distal portion 208B except that it is rounded in one dimension and therefore omits the edge 209C. The distal portion 222B comprises a curved surface extending from the second cross-section in the direction of propagation. In an alternative embodiment, the distal portion 222B may be rounded in two dimensions in an analogous manner to provide a distal portion similar to distal portion 214 except without the lateral edges 214F.

Figure 17A:
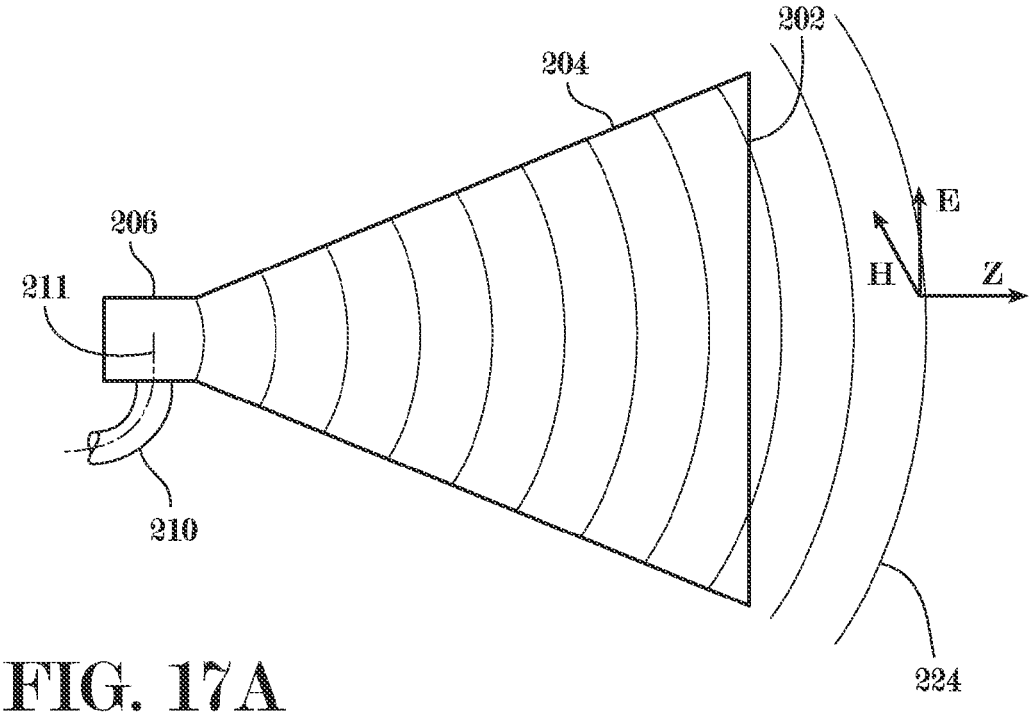
Figure 17B:
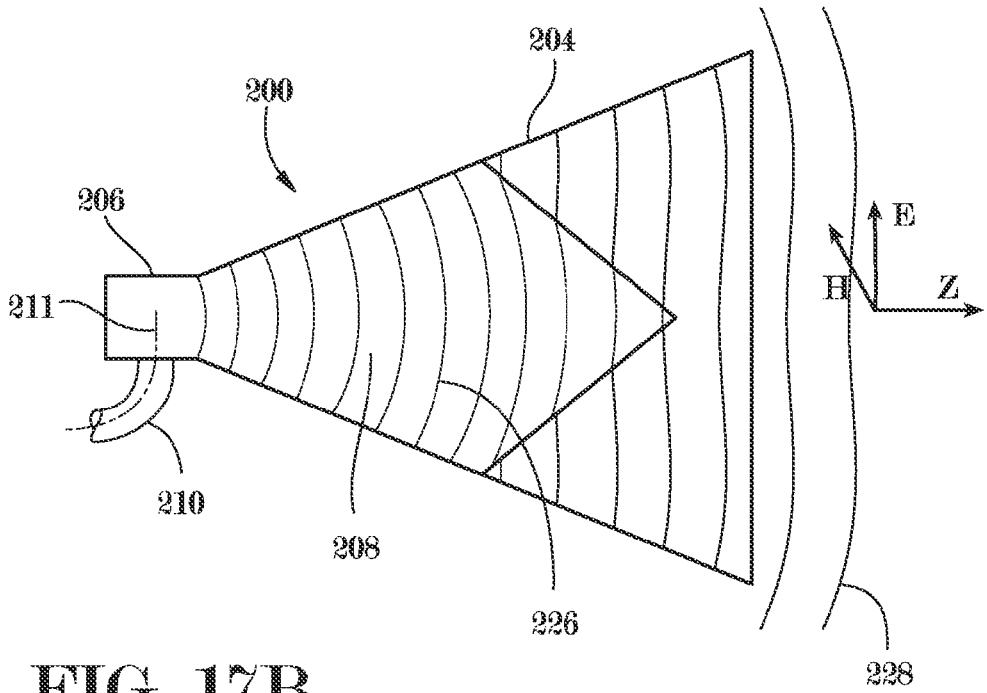

FIGS. 17A and 17B show conceptual representations of waves propagating through an aperture antenna without a dielectric component and through antenna 200, respectively. A perspective view of a three-dimensional coordinate system is shown where axes H and E represent the orientation of the H and E planes and axis Z is perpendicular to the H and E planes. Axes H and E also form a plane parallel to the distal aperture 202 which is normal to the Z-axis. Generally, the direction of propagation of waves 224 is in the Z-axis direction assuming a symmetrically constructed antenna and dielectric component. The spacing between succeeding waves 224 represents the wavelength of the waves 224 which propagate in space. In contrast, FIG. 17B illustrates waves 226 propagating through dielectric component 208 and waves 228 propagating in free-space. The three-dimensional pattern of waves 226 changes as the waves propagate out of dielectric component 208 and into free-space as indicated by discontinuities in the waves as portions of the waves reach surfaces 209A and 209B. Portions of the waves in free-space propagate faster than portions remaining in dielectric component 208 causing a flattening of the pattern which is evidenced by a shorter Z-dimension characteristic in waves 228 as compared to waves 224. The unmodified wave exhibits an unmodified directivity in the Z-axis direction. When the wave passes through dielectric component 208 it is altered, and the alteration comprises strengthening of the unmodified directivity. As the Z-axis dimension of the pattern flattens, directivity strengthens.

Figure 18:
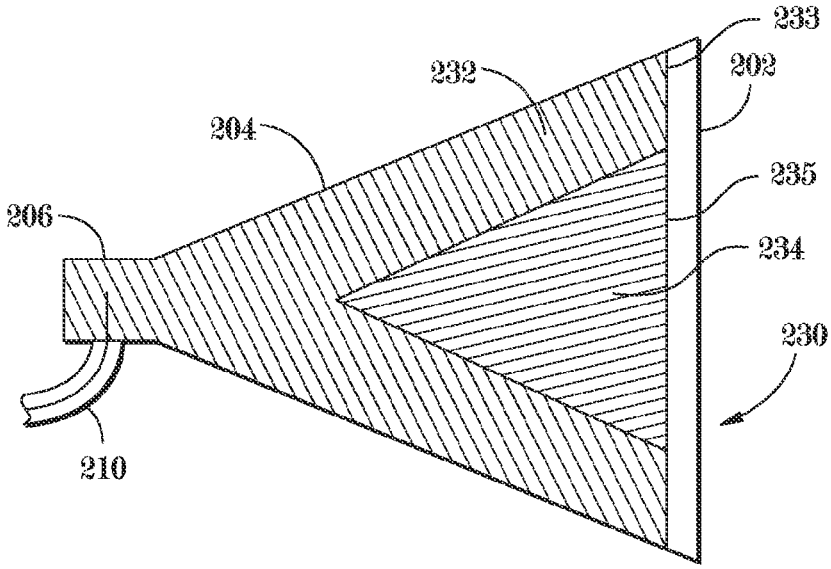
FIGS. 18 to 23 show lateral cross-sectional views and frontal plane views of embodiments of combinations of dielectric components partially embedded and/or encapsulated in other dielectric components.
Figure 19:
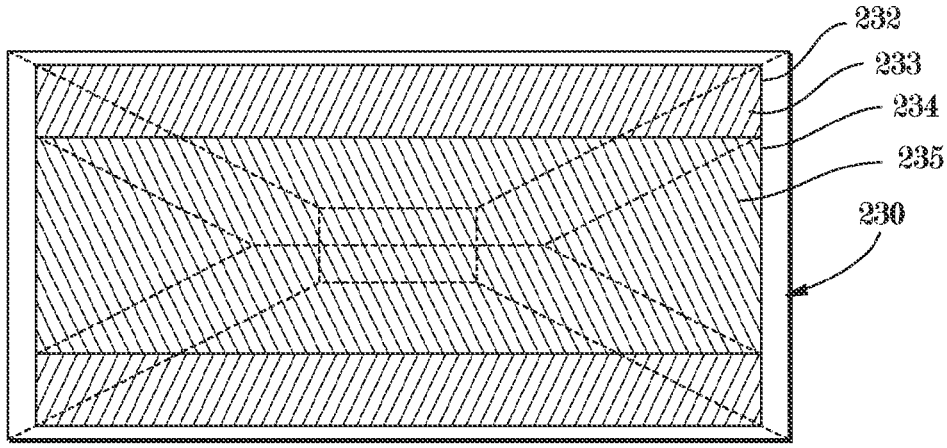
Figure 20:
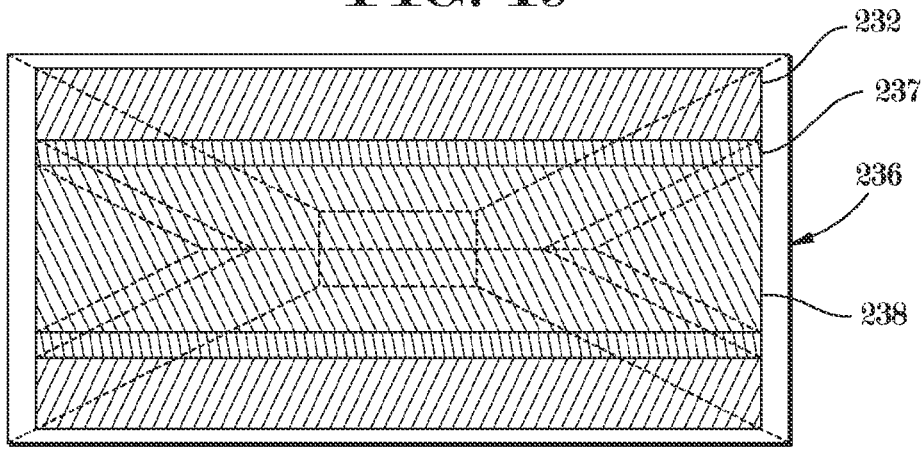
Figure 21:
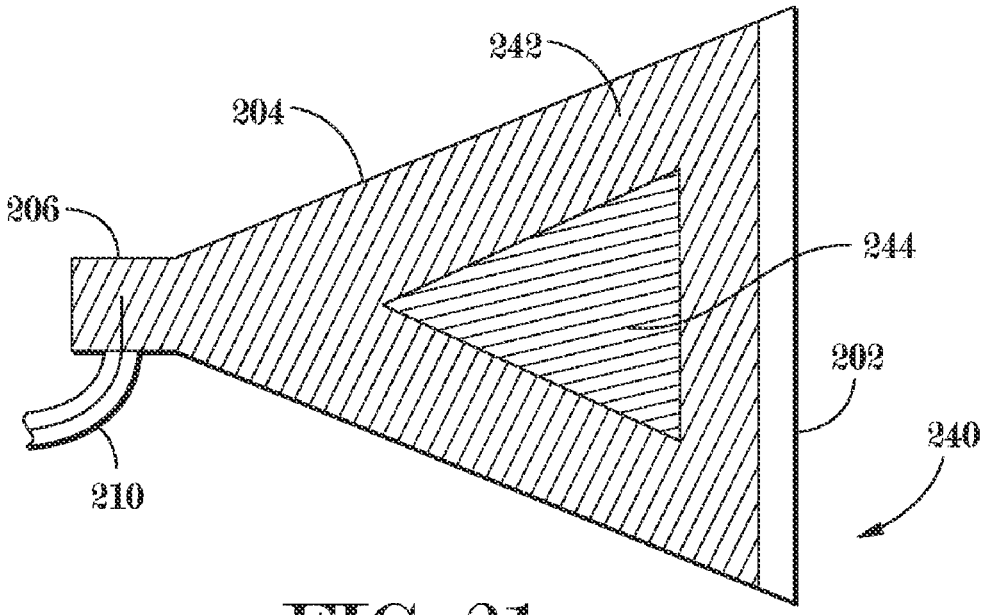

FIGS. 18 and 19 show an embodiment of an antenna 230 having two dielectric components 232 and 234. The dielectric component 232 may have any shape and comprises a opening or cavity into which the dielectric component 234 is placed. The dielectric components 232 and 234 have surfaces 233 and 235 exposed to free space, e.g., there are no additional interfaces between the surfaces 233 and 235 and space outside the horn 204. FIG. 20 illustrates an embodiment of an antenna with three dielectric components. Antenna 236 comprises dielectric component 232 and, further, dielectric component 238 embedded in dielectric component 237. A first component is embedded into a second component when at least a portion of the first component is not surrounded by the second component. By contrast, the first component is encapsulated by the second component if the second component entirely surrounds the first component. Thus defined, component 234 is embedded into component 232 and component 244 is encapsulated by component 242 as shown in FIG. 21. Additional dielectric components of varying dielectric constants may be embedded in a similar manner, or encapsulated, to modify the effective dielectric constant of the combination of dielectric components and the corresponding refraction interfaces.

Figure 22:
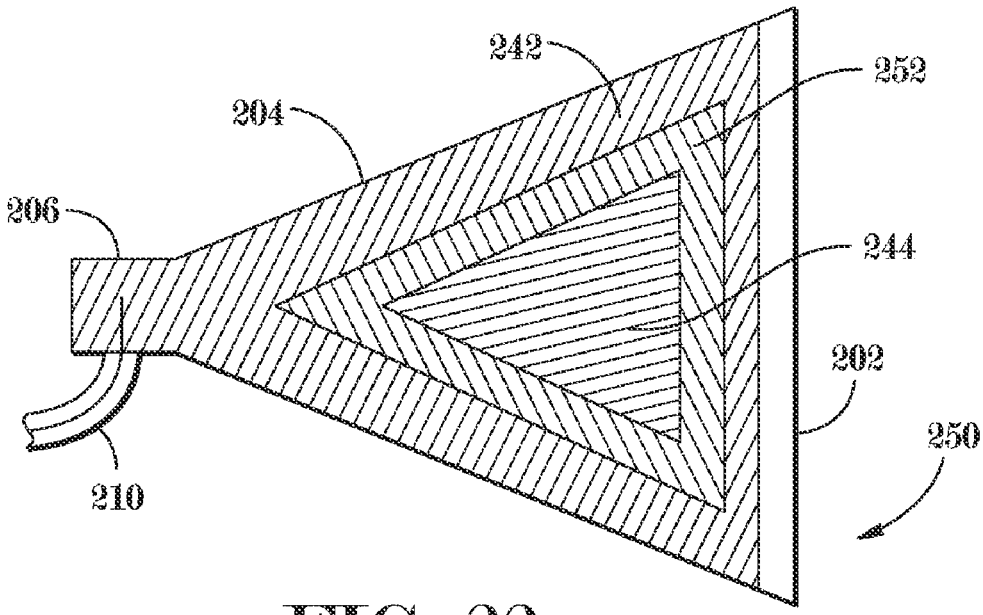
Figure 23:
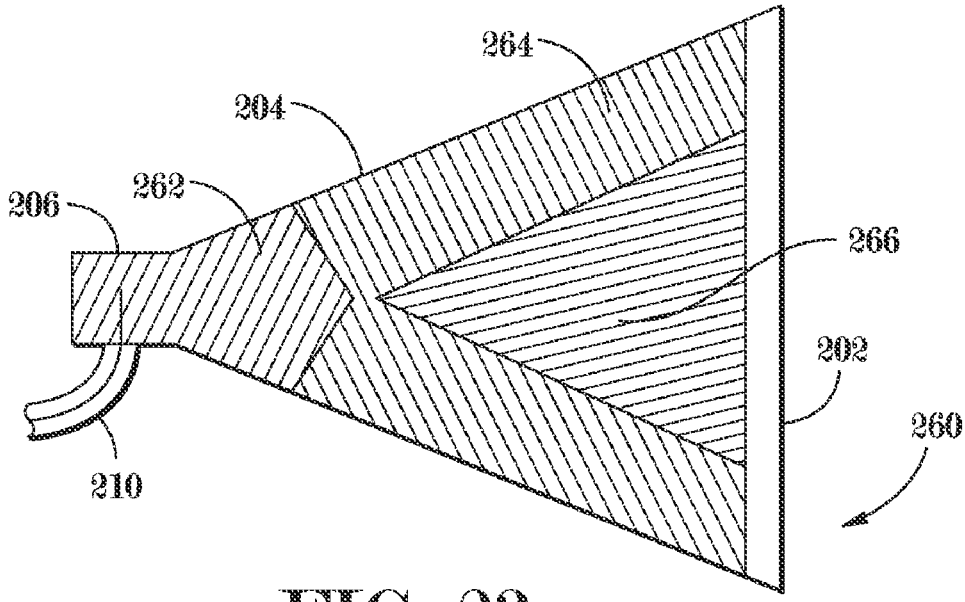

While the dielectric components 232, 237 and 238 are shown having a surface parallel to aperture 202 exposed to free space, dielectric components may also be encapsulated by other dielectric components as shown in FIGS. 21 to 23. FIG. 21 illustrates an antenna 240 having a dielectric component 244 encapsulated by a dielectric component 242. FIG. 22 illustrates an antenna 250 having a dielectric component 252 encapsulating a dielectric component 244 and both being encapsulated by the dielectric component 242. FIG. 23 illustrates an antenna 260 having a dielectric component 266 partially embedded in a dielectric component 264, and a dielectric component 262 inserted in the throat 206 and a portion of the horn 204 of the antenna 260. The dielectric component 262 may, illustratively, comprise a dielectric constant higher than the dielectric constant of dielectric component 264.

Figure 24:
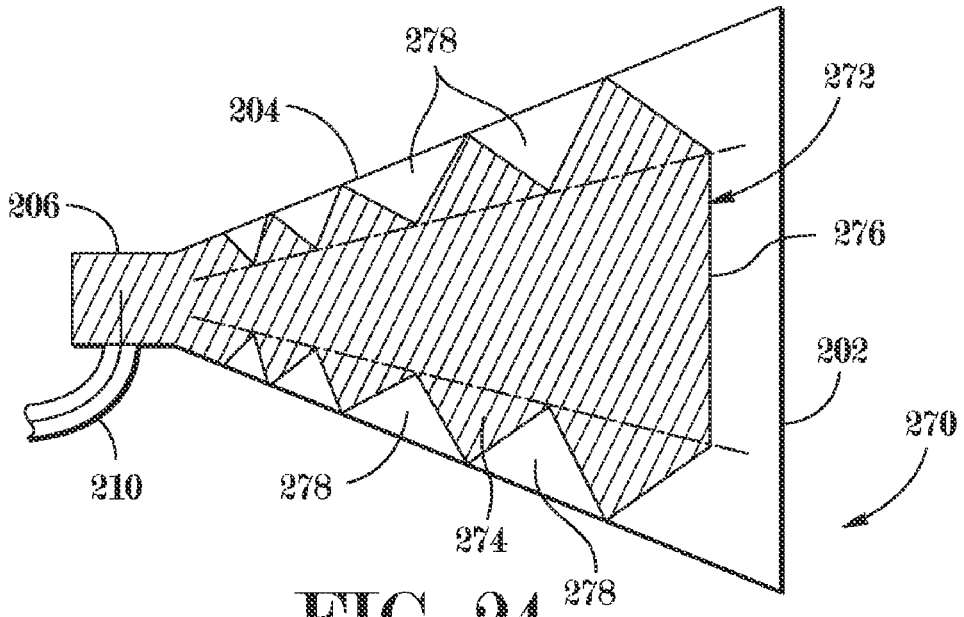
FIGS. 24 to 27 show lateral cross-sectional views and frontal plane views of embodiments of dielectric components having ridges and cavities.
Figure 25:
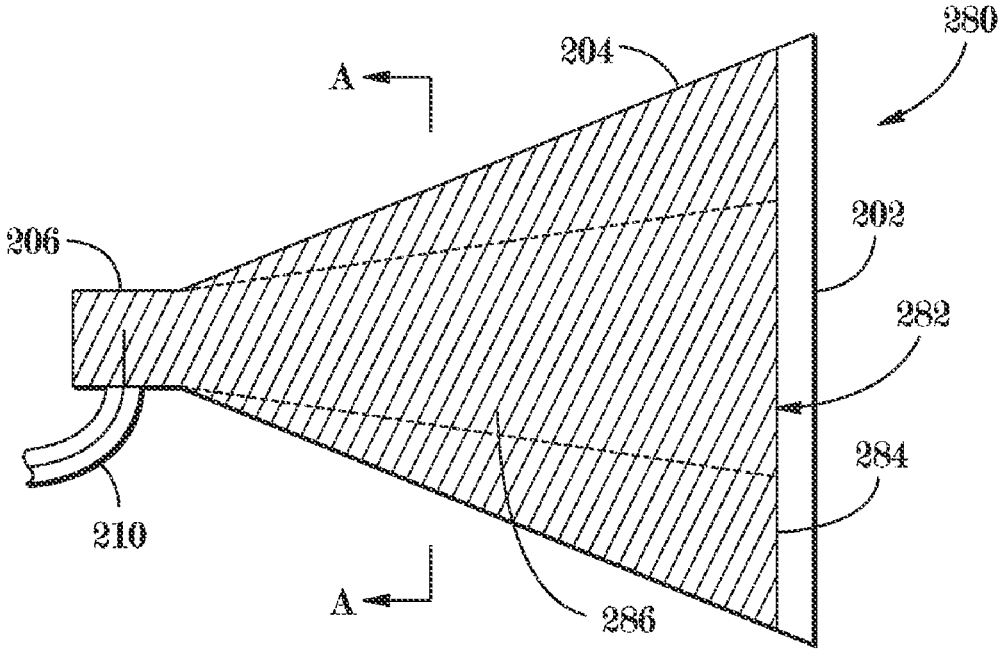
Figure 26:
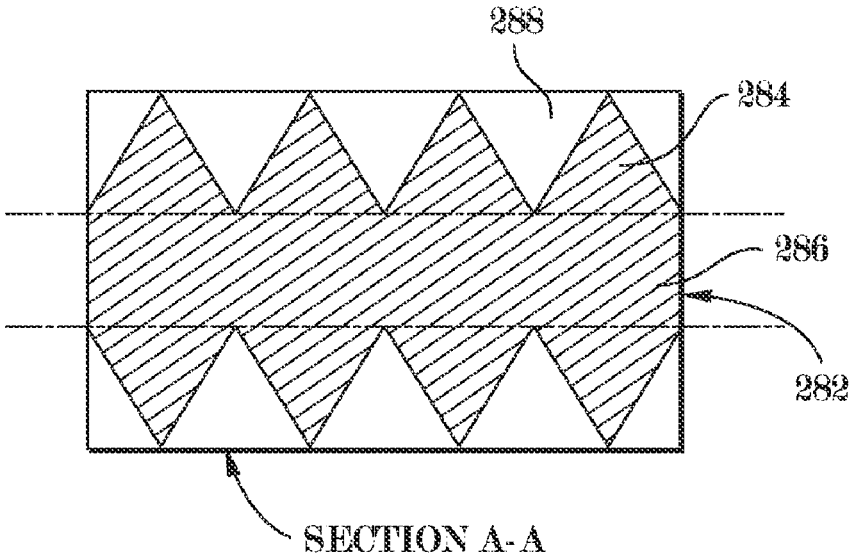

Hereinabove dielectric components have been shown with substantially continuous surfaces. In the following embodiments of aperture antennas with dielectric components, a number of variations are exemplified which disrupt the continuous surfaces. FIG. 24 illustrates an antenna 270 including a dielectric component 272 having a plurality of elongate ridges 274 of triangular cross-section extending from a body 276 and forming a plurality of complementary elongate openings, cavities, or slots 278. The elongate ridges 274 are aligned transversely to the propagation path of the antenna 270. The elongate ridges may also exhibit square, semi-circular and any other desirable shape suitable for the purpose of creating phase delays of varying characteristics. In an alternative embodiment, the slots 278 are filled with dielectric components which may have the same or different dielectric constants. FIGS. 25 and 26 illustrate an antenna 280 including a dielectric component 282 having a plurality of elongate ridges 284 of triangular cross-section extending from a body 286 and forming a plurality of complementary slots 288. The elongate ridges may also exhibit square, semi-circular and any other desirable shape suitable for the purpose of creating phase delays of varying characteristics. In an alternative embodiment, the slots 288 are filled with dielectric components which may have the same or different dielectric constants.

Figure 27:
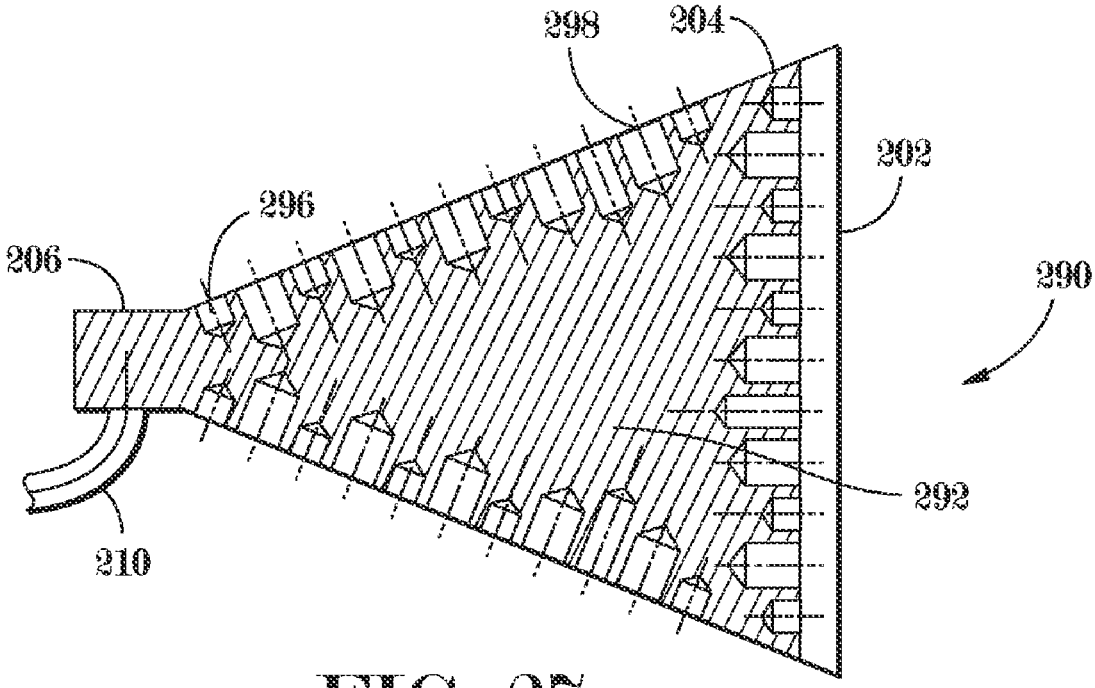

FIG. 27 illustrates an antenna 290 including a dielectric component 292 having a plurality of cavities 296 and 298 of different shapes and sizes. The cavities 296 and 298 may comprise any shape such as cylindrical, square, pyramidal and the like. In an alternative embodiment, the cavities 296 and 298 are filled with dielectric components of different dielectric constants. The cavities 296 and 298 may also comprise equal shapes and sizes. The cavities 296 and 298 include a centerline which may be oriented at any angle.

Figure 28:
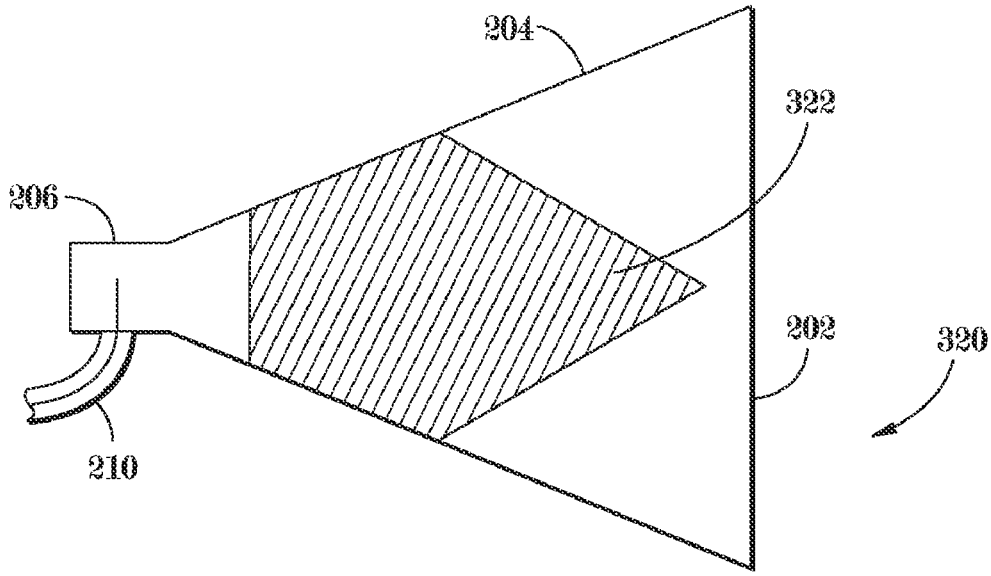
FIGS. 28 and 29 show lateral cross-sectional views of further embodiments of dielectric components inserted in aperture antennas.
Figure 29:
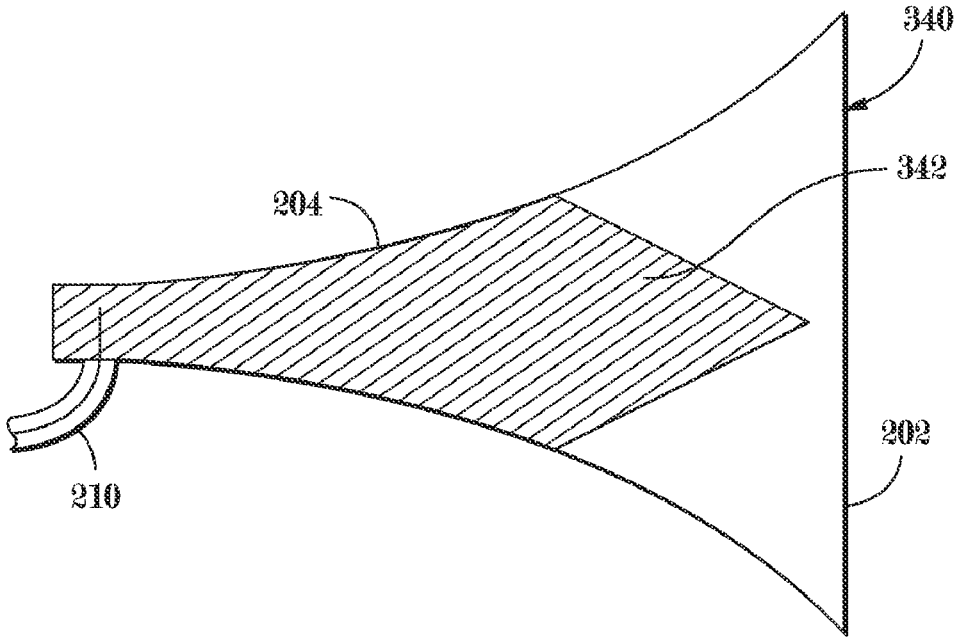

FIGS. 28 and 29 illustrate further embodiments of aperture antennas with dielectric components. Antenna 320, shown in FIG. 28, comprises a dielectric component 322 which does not penetrate into the throat 206 of the antenna 320. Antenna 340, shown in FIG. 29, comprises a horn which exhibits curved surfaces which extend into what has been defined as the throat of the antenna but which, due to the curvature of the horn, is formed integrally with the horn. As a result, there is no physical transition between the throat and the horn 204. A dielectric component 342 is shown which may be constructed as described hereinabove with reference to FIGS. 14 to 28.

The embodiment of the manufacturing method described with reference to FIG. 13 may also be adapted to manufacture the dielectric loaded aperture antenna. The method comprises, in summary form, the steps of providing suitable dielectric component(s) and aperture antennas, and inserting the dielectric component(s) into the antennas. Suitable dielectric components may be injection molded or machined into desirable shapes. Portions of dielectric components may be machined and subsequently coated with layers of dielectric material. In one embodiment, a dielectric component may be permanently attached to the antenna with an adhesive layered between at least portions of the antenna's internal surface and the dielectric component, and the adhesive may itself be a dielectric component. Where a dielectric component is encapsulated by another, the encapsulating component may comprise a fluid barrier and the encapsulated component may comprise a fluid, e.g. gas or liquid, which may be injected into the encapsulating component. A person having skill in the material sciences or plastics processing arts will understand that dielectric components may be produced in a multiplicity of known techniques.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. An antenna structure comprising:

a first antenna element comprising an elongate channel having an internal conductive surface and an apertured proximal end spaced apart from, and flaring out to, an apertured distal end, said conductive surface providing a propagation path, and said proximal end receiving EM waves in a first EM radiation pattern;

a second antenna element positioned at least partially within said first antenna element, said second antenna element having a proximal portion coupled to a distal portion, said proximal portion flaring out from a proximal portion proximal end having a first cross-sectional area to proximal portion distal end having a second cross-sectional area larger than said first cross-sectional area, and said distal portion having a distal portion proximal end coupled to said proximal portion distal end and flaring in towards said apertured distal end, and said second antenna element introducing a phase delay along said propagation path adapted to at least partially flatten a phase front of said first EM radiation pattern to produce a second EM radiation pattern; and a third antenna element adapted to output said EM waves, wherein said second antenna element extends into said third antenna element;

wherein said proximal portion proximal end extends at least to said apertured proximal end of said first antenna element.

2. The antenna structure of claim 1, wherein said distal portion of said second antenna element comprises two converging substantially flat surfaces.

3. The antenna structure of claim 1, wherein said distal portion comprises a curved surface extending from said distal portion proximal end.

4. The antenna structure of claim 1, wherein said second antenna element comprises metal coated particles.

5. An antenna structure comprising:

a first antenna element comprising an elongate channel having an internal conductive surface and an apertured proximal end spaced apart from, and flaring out to, an apertured distal end, said conductive surface providing a propagation path, and said proximal end receiving EM waves in a first EM radiation pattern;

a second antenna element positioned at least partially within said first antenna element, said second antenna element having a first dielectric constant; and a third antenna element positioned at least partially within said second antenna element, said third antenna element having a second dielectric constant, wherein said second and third antenna elements introduce phase delays along said propagation path adapted to at least partially flatten a phase front of said first EM radiation pattern to produce a second EM radiation pattern.

6. The antenna structure of claim 5, wherein said second antenna element comprises a first surface exposed to free space.

7. The antenna structure of claim 6, wherein said first surface is oriented substantially parallel to said apertured distal end of said first antenna element.

8. The antenna structure of claim 6, wherein said third antenna element comprises a second surface exposed to free space.

9. The antenna structure of claim 6, wherein said third antenna element is encapsulated by said second antenna element.

10. The antenna structure of claim 6, further including at least an additional antenna element having a third dielectric constant encapsulated by said second and third antenna elements, wherein said third dielectric constant is different from said first dielectric constant.

11. The antenna structure of claim 5, further including a fourth antenna element adapted to output said EM waves in said first EM radiation pattern, wherein said second antenna element extends into said third antenna element.

12. The antenna structure of claim 11, further including said fourth antenna element and a fifth antenna element comprising a fourth dielectric constant positioned in said fourth antenna element, wherein said fourth dielectric constant is different from said first dielectric constant.

13. The antenna structure of claim 12, wherein said fifth antenna element flares out from said fourth antenna element as it extends into said first antenna element.

14. The antenna structure of claim 5, wherein at least one of said second and third antenna elements comprise metal coated particles.

15. An antenna structure comprising:

a first antenna element comprising an elongate channel having an internal conductive surface and an apertured proximal end spaced apart from, and flaring out to, an apertured distal end, said conductive surface providing a propagation path, and said proximal end receiving EM waves in a first EM radiation pattern; and a second antenna element positioned at least partially within said first antenna element, said second antenna element having at least one opening on its surface, wherein said second antenna element introduces a phase delay along said propagation path adapted to at least partially flatten a phase front of said first EM radiation pattern to produce a second EM radiation pattern;

wherein said second component has a first dielectric constant and said at least one opening is filled with a third antenna component having a second dielectric constant.

16. The antenna structure of claim 15, wherein said opening comprises a channel.

17. The antenna structure of claim 16, wherein said channel is oriented in a direction comprising one of substantially perpendicular and substantially parallel to said propagation path.

18. The antenna structure of claim 15, wherein said at least one opening comprises a plurality of elongate cavities.

19. The antenna structure of claim 18, wherein said plurality of elongate cavities comprise at least two differently sized cavities.

20. An antenna structure comprising:

a first antenna element comprising an elongate channel having an internal conductive surface and an apertured proximal end spaced apart from, and flaring out to, an apertured distal end, said conductive surface providing a propagation path, and said proximal end receiving EM waves in a first EM radiation pattern; and a second antenna element positioned at least partially within said first antenna element, said second antenna element having a proximal portion coupled to a distal portion, said proximal portion flaring out from a proximal portion proximal end having a first cross-sectional area to proximal portion distal end having a second cross-sectional area larger than said first cross-sectional area, and said distal portion having a distal portion proximal end coupled to said proximal portion distal end and flaring in towards said apertured distal end, and said second antenna element introducing a phase delay along said propagation path adapted to at least partially flatten a phase front of said first EM radiation pattern to produce a second EM radiation pattern, wherein said second antenna element comprising a material adapted to refract a portion of said first EM radiation pattern to produce a second EM radiation pattern which has a reference axis being substantially orthogonal to another reference axis associated with said first antenna element, said second antenna element adapted in spatial relation to a portion of said first antenna element such that a portion of said first EM radiation pattern is modified thereby creating said second EM radiation pattern which has a directivity substantially strengthened in the direction of a reference plane substantially orthogonal to said another reference axis associated with said first antenna element, wherein said second antenna element produces said second EM radiation pattern has a modified directivity substantially strengthened in the direction of said another reference axis associated with said first antenna element relative to an unmodified directivity of the first EM radiation pattern, said unmodified directivity being the directivity said EM wave would exhibit in said first antenna element without said second antenna element.

21. The antenna structure of claim 20, further including a third antenna element adapted to output said EM waves, wherein said second antenna element extends into an in proximity to said third antenna element.

22. An antenna structure comprising:

a first antenna structure comprising a first antenna element comprising an elongate channel having an internal conductive surface and an apertured proximal end spaced apart from, and flaring out to, an apertured distal end, said conductive surface providing a propagation path, and said proximal end receiving EM waves in a first EM radiation pattern, and a second antenna element positioned at least partially within said first antenna element, said second antenna element having a proximal portion coupled to a distal portion, said proximal portion flaring out from a proximal portion proximal end having a first cross-sectional area to proximal portion distal end having a second cross-sectional area larger than said first cross-sectional area, and said distal portion having a distal portion proximal end coupled to said proximal portion distal end and flaring in towards said apertured distal end, and said second antenna element introducing a phase delay along said propagation path adapted to at least partially flatten a phase front of said first EM radiation pattern to produce a second EM radiation pattern, said second antenna element comprising a material adapted to refract a portion of said first EM radiation pattern to produce a second EM radiation pattern which has a reference axis being substantially orthogonal to another reference axis associated with said first antenna element, said second antenna element adapted in spatial relation to a portion of said first antenna element such that a portion of said first EM radiation pattern is modified thereby creating said second EM radiation pattern which has a directivity substantially strengthened in the direction of a reference plane substantially orthogonal to said another reference axis associated with said first antenna element, wherein said second antenna element produces said second EM radiation pattern has a modified directivity substantially strengthened in the direction of said another reference axis associated with said first antenna element relative to an unmodified directivity of the first EM radiation pattern, said unmodified directivity being the directivity said EM wave would exhibit in said first antenna element without said second antenna element;

a second antenna structure comprising a fourth antenna element, said fourth antenna element being adapted to produce a first EM radiation pattern associated with said second antenna structure comprising a first and second reference axis associated with said second antenna structure, and a fifth antenna element, said fifth antenna element comprising a material adapted to refract a portion of said first EM radiation pattern associated with said second antenna structure to produce a second EM radiation pattern associated with said second antenna structure which has a third reference axis associated with said second antenna structure being substantially orthogonal to said first reference axis associated with said second antenna structure, wherein said fifth antenna element is adapted to modify said first EM radiation pattern associated with said second antenna structure by delaying a portion of said first EM radiation pattern associated with said second antenna structure to cause a phase shift that results in said second EM radiation pattern associated with said second antenna structure;

a third antenna structure comprising a sixth antenna element, said sixth antenna element being adapted to produce a first EM radiation pattern associated with said third antenna structure comprising a first reference axis associated with said third antenna structure and a first plane associated with said third antenna structure being substantially orthogonal to said first reference axis associated with said third antenna structure, and a seventh antenna element, said seventh antenna element adapted in spatial relation to a portion of said sixth antenna element such that a portion of said first EM radiation pattern associated with said third antenna structure is modified thereby creating a second EM radiation pattern associated with said third antenna structure which has a directivity substantially strengthened in the direction of said first reference plane associated with said third antenna structure; and a fourth antenna structure comprising an eighth antenna element, said eighth antenna element being adapted to produce a wave having a first EM radiation pattern associated with said fourth antenna structure comprising a first reference axis associated with said fourth antenna structure and a first plane associated with said fourth antenna structure being substantially orthogonal to said first reference axis associated with said fourth antenna structure, and a ninth antenna element coupled to said eighth antenna element, said ninth antenna element having an input opening and an output opening defining an elongate channel therebetween, said channel being substantially aligned with said first reference axis associated with said fourth antenna structure, and said input opening being configured to receive said wave, and a tenth antenna element, said tenth antenna element positioned at least partially within said ninth antenna element and adapted to modify said wave to create a second EM radiation pattern associated with said fourth antenna structure, said second EM radiation pattern associated with said fourth antenna structure having a modified directivity substantially strengthened in the direction of said first reference axis associated with said fourth antenna structure relative to an unmodified directivity of the first EM radiation pattern associated with said fourth antenna structure, said unmodified directivity being the directivity said wave would exhibit in said ninth antenna element without said tenth antenna element.

23. The antenna structure of claim 22, wherein said distal portion of said second antenna element comprises two converging substantially flat surfaces.

24. The antenna structure of claim 22, wherein said distal portion of said second antenna element comprises a curved surface extending from said distal portion proximal end of said second antenna element.

25. The antenna structure of claim 22, wherein said proximal portion proximal end extends at least to said apertured proximal end of said first antenna element.

26. The antenna structure of claim 25, further including a third antenna element adapted to output said EM waves, wherein said second antenna element extends into said third antenna element.

27. The antenna structure of claim 22, wherein said second antenna element comprises metal coated particles.

28. The antenna structure of claim 22, wherein said fifth antenna element comprises a plurality of dielectric material layers.

29. The antenna structure of claim 28, wherein at least one of said dielectric material layers includes metal coated particles.

30. The antenna structure of claim 22, wherein said seventh antenna element is adapted to modify said first EM radiation pattern associated with said third antenna structure by delaying a portion of said first EM radiation pattern associated with said third antenna structure to cause a phase shift that results in said second EM radiation pattern associated with said third antenna structure.

* * * * *